US010185269B2

(12) United States Patent
Iwata

(10) Patent No.: US 10,185,269 B2
(45) Date of Patent: Jan. 22, 2019

(54) IMAGE FORMING APPARATUS AND METHOD FOR FORMING AN IMAGE

(71) Applicant: Muneaki Iwata, Kanagawa (JP)

(72) Inventor: Muneaki Iwata, Kanagawa (JP)

(73) Assignee: Ricoh Company Ltd., Tokyo (JP)

( * ) Notice: Subject to any disclaimer, the term of this patent is extended or adjusted under 35 U.S.C. 154(b) by 67 days.

(21) Appl. No.: 15/368,791

(22) Filed: Dec. 5, 2016

(65) Prior Publication Data

US 2017/0160687 A1 Jun. 8, 2017

(30) Foreign Application Priority Data

Dec. 7, 2015 (JP) ..... 2015-238696

(51) Int. Cl.
*G03G 15/00* (2006.01)

(52) U.S. Cl.
CPC ..... *G03G 15/556* (2013.01); *G03G 15/5058* (2013.01); *G03G 2215/0132* (2013.01); *G03G 2215/0161* (2013.01); *G03G 2215/0164* (2013.01)

(58) Field of Classification Search
CPC ..... G03G 15/043; G03G 15/5041; G03G 15/5054; G03G 13/04; G03G 15/04072; G03G 15/556; G03G 15/5058; G03G 2215/0132; G03G 2215/0161; G03G 2215/0164
See application file for complete search history.

(56) References Cited

U.S. PATENT DOCUMENTS 7,663,654 B2 2/2010 Arai et al.
8,610,971 B2 12/2013 Omori et al.
8,648,892 B2 2/2014 Suzuki et al.
8,929,759 B2 1/2015 Iwata et al.
2014/0301748 A1* 10/2014 Suzuki ..... G03G 15/5025 399/49
2016/0274521 A1 9/2016 Iwata et al.

FOREIGN PATENT DOCUMENTS

JP 2007-144731 6/2007
JP 2007-296782 11/2007
JP 2016-173489 9/2016

OTHER PUBLICATIONS

U.S. Appl. No. 15/203,081, filed Jul. 6, 2016.

* cited by examiner

*Primary Examiner* — Ruifeng Pu
(74) *Attorney, Agent, or Firm* — Harness, Dickey & Pierce, P.L.C.

(57) ABSTRACT

An image forming apparatus includes: a photoconductor drum; an optical scanner, having a light source, configured to scan the photoconductor drum with light to form a latent image; a developer configured to develop an image, based on the latent image; a cycle detector configured to detect a rotation cycle of the photoconductor drum, to produce a cyclic signal indicative of the rotation cycle; a density detector configured to detect density of the image; a measurer configured to measure the rotation cycle at each rotation, based on the cyclic signal; a generator configured to generate, based on the density, a correcting value for correcting intensity of the light, the correcting value having a correction cycle based on a measurement result of the measurer; and an adjuster configured to adjust the correction cycle based on the rotation cycle measured at each rotation, so that the correction cycle matches the rotation cycle.

18 Claims, 25 Drawing Sheets

SIGHP
SIGSCT
SIGRD
SIGTAB
SIGC
RTS
0
3
4
4
0
0
0
1
1
1
1
1
1
1
1
2
1
1
1
1
1
1
1
1

SIGHP
SIGSCT
SIGRD
SIGTAB
SIGC
RTN
0
3
4
4
0
0
0
1
1
1

IMAGE FORMING APPARATUS AND METHOD FOR FORMING AN IMAGE

CROSS-REFERENCE TO RELATED APPLICATIONS

The present application claims the benefit of priority under 35 U.S.C. § 119 of Japanese Patent Application No. 2015-238696, filed Dec. 7, 2015, the contents of which are incorporated herein by reference in their entirety.

BACKGROUND OF THE INVENTION

1. Field of the Invention

The present disclosure relates to image forming apparatuses and methods for forming an image.

2. Description of the Related Art

A conventional electrophotographic image forming apparatus may cause, what is called, density unevenness with respect to a formed image. For the purpose of decreasing such density unevenness, various ways of correction may be performed.

For example, exposure energy may be adjusted in order to correct density unevenness. In such a way of correction, a change in exposure energy may cause a deviation with respect to a starting position of writing a latent image. Here, there is a way to prevent such a deviation with respect to a starting position of writing a latent image, which is caused by a change in exposure energy. Specifically, a standby time is predetermined by a control unit provided in an image forming apparatus, based on intensity of luminous flux. Then, upon passage of the predetermined standby time, measuring from a time when intensity of a signal which is output from a reference sensor exceeds a threshold value, an exposure unit provided in the image forming apparatus emits luminous flux in accordance with image data. In such a way, the deviation with respect to a starting position of writing an electrostatic latent image may be prevented, by correcting a deviation with respect to a timing to start writing the electrostatic latent image in a main-scanning direction, which is caused by a difference of a value of intensity of luminous flux from a predetermined value (for example, see Japanese Unexamined Patent Application Publication No. 2007-296782).

SUMMARY OF THE INVENTION

One aspect of the present invention provides an image forming apparatus that forms an image. The image forming apparatus includes a photoconductor drum, an optical scanner, having a light source for emitting light to irradiate the photoconductor drum, configured to scan the photoconductor drum with the light to form a latent image on the photoconductor drum, a developer configured to perform developing of an image, based on the latent image, a cycle detector configured to detect a rotation cycle of the photoconductor drum, to produce a cyclic signal indicative of the rotation cycle, a density detector configured to detect density of the image formed by the developer, a measurer configured to measure the rotation cycle at each rotation, based on the cyclic signal, a generator configured to generate, based on the density, a correcting value for correcting intensity of the light emitted by the light source, the correcting value having a correction cycle based on a measurement result of the measurer, and an adjuster configured to adjust the correction cycle based on the rotation cycle measured at each rotation, so that the correction cycle matches the rotation cycle.

DESCRIPTION OF THE EMBODIMENTS

A problem concerning the conventional technique is that a cycle for correcting light intensity tends to deviate from a cycle of change in density.

An object of an embodiment of the present invention is to provide an image forming apparatus capable of decreasing the deviation between the cycle for correcting light intensity and the cycle of change in density.

According to the present invention, the deviation between the cycle for correcting light intensity and the cycle of change in density may be decreased.

In the following, an embodiment of the present invention will be described with reference to accompanying drawings. Here, in the description and the drawings, constituent elements having substantially the same functional configurations will be assigned the same reference signs so that duplicated explanations will be omitted.

<Example of Image Forming Apparatus>

Figure 1:
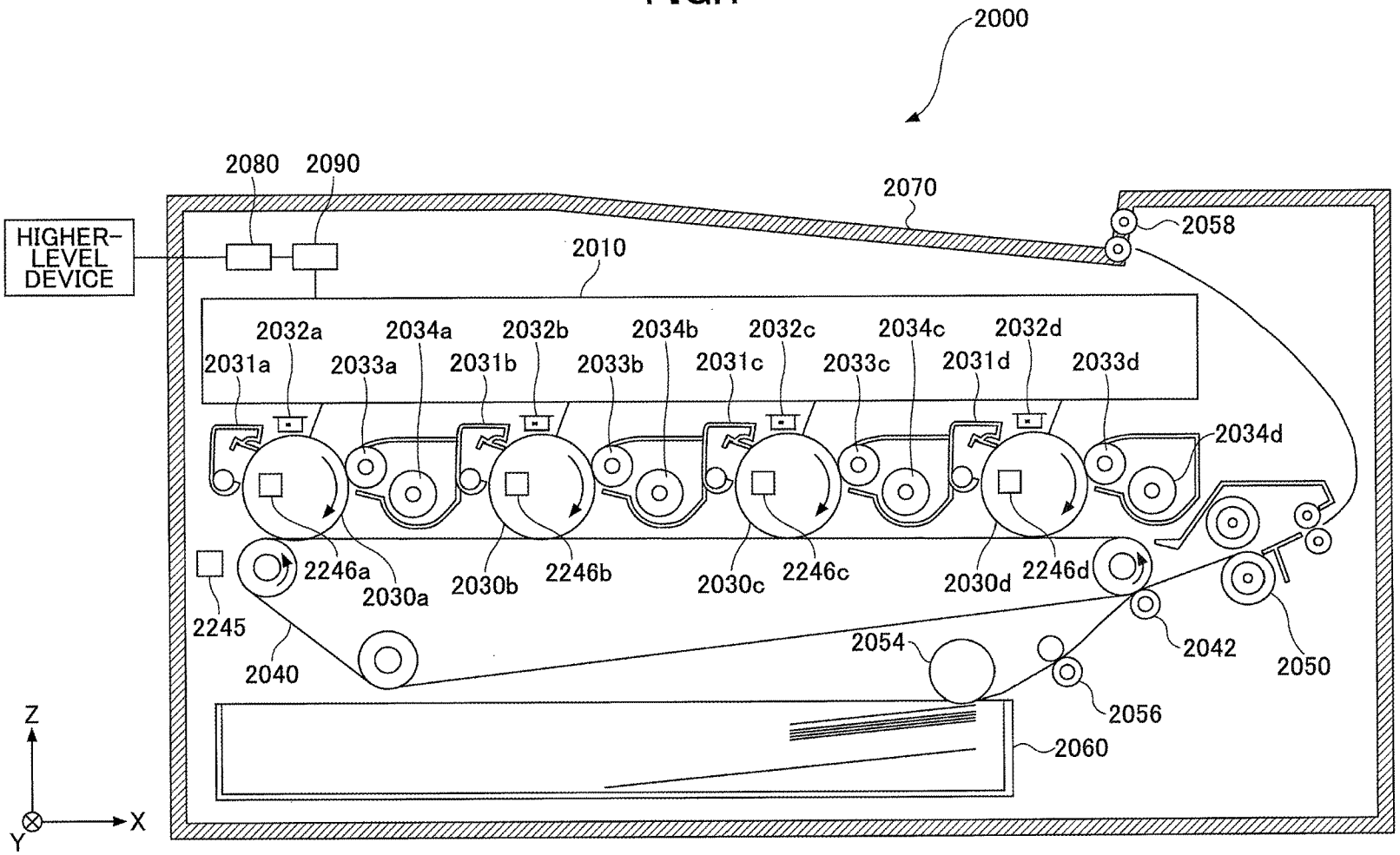
FIG. 1 is a drawing illustrating an example of a schematic configuration of an image forming apparatus, according to an embodiment of the present invention.

FIG. 1 is a drawing illustrating an example of a schematic configuration of an image forming apparatus, according to the embodiment of the present invention. In the following description, a color printer 2000, which is illustrated in FIG. 1, will be discussed as an example of the image forming apparatus. Further, in the example, the color printer 2000 utilizes combinations of four colors in order to form a full-color image on a recording medium such as a paper. Here, the four colors may be, for example, black (K), cyan (C), magenta (M), yellow (Y), etc. In the following, the colors may be indicated by "K", "C", "M", or "Y", respectively. The color printer 2000 is a so-called tandem multi-color printer.

Further, as illustrated in FIG. 1, the longitudinal direction of the photoconductor drums 2030*a* through 2030*d* is a Y-axis of a three-dimensional orthogonal coordinate system. The direction that is orthogonal to the Y-axis, along which the photoconductor drums 2030*a* through 2030*d* are arranged, is an X-axis. Furthermore, the direction that is orthogonal and vertical to both of the Y-axis and the X-axis is a Z-axis. Further, in the following description, the Y-axis may be referred to as a main-scanning direction, whereas the X-axis may be referred to as a sub-scanning direction.

The color printer 2000 includes an optical scanning control device 2010 that is provided with a light source, an optical system for scanning the photoconductor drums 2030*a* through 2030*d* with light emitted by the light source, etc. That is to say, the optical scanning control device 2010 is a so-called exposure device. Furthermore, the color printer 2000 includes photoconductor drums 2030*a* through 2030*d* one for each color. The color printer 2000 includes cleaning units 2031*a* through 2031*d* for the photoconductor drums 2030*a* through 2030*d*, respectively. The color printer 2000 further includes charging devices 2032*a* through 2032*d*. The color printer 2000 further includes developing rollers 2033*a* through 2033*d*. The color printer 2000 further includes toner cartridges 2034*a* through 2034*d*.

Furthermore, the color printer 2000 includes a transfer belt 2040, a transfer roller 2042, a fixing roller 2050, a paper feeding roller 2054, a registration roller pair 2056, a paper ejection roller 2058, etc. The color printer 2000 further includes a paper feeding tray 2060, a paper ejection tray 2070, a communication control device 2080, a density detector 2245, etc.

The color printer 2000 includes home position sensors 2246*a* through 2246*d*. Furthermore, the color printer 2000 includes a printer control device 2090, which controls electric potential sensors and the above-described hardware.

In the following description, an arbitrary photoconductor drum may be referred to as a photoconductor drum 2030, without differentiating the photoconductor drums 2030*a* through 2030*d*. Similarly, in the following description, an arbitrary developing roller may be referred to as a developing roller 2033, without differentiating the developing rollers 2033*a* through 2033*d*.

The color printer 2000 is coupled to a higher-level device such as a personal computer (PC) via a network, etc. Further, the communication control device 2080 allows the color printer 2000 to intercommunicate with external devices such as the higher-level device via the network, etc.

The printer control device 2090 includes an arithmetic unit or a control unit such as a central processing unit (CPU). The printer control device 2090 further includes a memory unit such as a read-only memory (ROM) for storing programs for allowing the CPU to execute processing and data used by the CPU. The printer control device 2090 further includes a main memory unit such as a random access memory (RAM) which provides a work area for the CPU. The printer control device 2090 further includes an analog-digital (A/D) conversion circuit for converting analog data into digital data, etc.

Furthermore, the photoconductor drum 2030*a*, the charging device 2032*a*, the developing roller 2033*a*, the toner cartridge 2034*a*, and the cleaning unit 2031*a* form an image forming station, which functions as a unit, for forming a black image. In the following, the image forming station may be referred to as a K-station.

Similarly, the photoconductor drum 2030*b*, the charging device 2032*b*, the developing roller 2033*b*, the toner cartridge 2034*b*, and the cleaning unit 2031*b* form an image forming station, which functions as a unit, for forming a cyan image. In the following, the image forming station may be referred to as a C-station.

Similarly, the photoconductor drum 2030*c*, the charging device 2032*c*, the developing roller 2033*c*, the toner cartridge 2034*c*, and the cleaning unit 2031*c* form an image forming station, which functions as a unit, for forming a magenta image. In the following, the image forming station may be referred to as an M-station.

Similarly, the photoconductor drum 2030*d*, the charging device 2032*d*, the developing roller 2033*d*, the toner cartridge 2034*d*, and the cleaning unit 2031*d* form an image forming station, which functions as a unit, for forming a yellow image. In the following, the image forming station may be referred to as a Y-station.

In the following description, an arbitrary image forming station may be simply referred to as a station, without differentiating the K-station, C-station, M-station, and Y-station.

The photoconductor drums 2030*a* through 2030*d* include photosensitive layers on the surfaces, respectively. That is to say, the surfaces of the photoconductor drums 2030*a* through 2030*d* are scanned surfaces, which are irradiated with the light from the respective light sources. Here, the photoconductor drums 2030*a* through 2030*d* are rotated in the directions of arrows by rotation mechanisms, as illustrated in FIG. 1.

The charging devices 2032*a* through 2032*d* electrically charge the surfaces of the photoconductor drums 2030*a* through 2030*d*, respectively.

As an example, upon a request from the higher-level device, etc., the printer control device 2090 controls the hardware, so as to transmit image data from the higher-level device to the optical scanning control device 2010.

The optical scanning control device 2010 irradiates the surfaces of the photoconductor drums 2030*a* through 2030*d* of each color with luminous flux that are adjusted for the respective colors based on the image data. When irradiated with light, irradiated regions of the surfaces of the photoconductor drums 2030*a* through 2030*d* are electrically discharged. Thus, when irradiated with light, latent images are formed on the surfaces of the respective photoconductor drums 2030*a* through 2030*d*, based on the image data. The latent images are moved towards the respective developing rollers 2033*a* through 2033*d* as the photoconductor drums 2030*a* through 2030*d* rotate. Details of the optical scanning control device 2010 will be explained later. Here, the written regions, in other words, the regions on which latent images are formed based on image data, etc., may be referred to as effective scanned regions, image forming regions, effective imaging regions, etc.

The toner cartridge 2034*a* stores black toner. The black toner is provided to the developing roller 2033*a*. Similarly, the toner cartridge 2034*b* stores cyan toner. The cyan toner is provided to the developing roller 2033*b*. Further, the toner cartridge 2034*c* stores magenta toner. The magenta toner is provided to the developing roller 2033*c*. Further, the toner cartridge 2034*d* stores yellow toner. The yellow toner is provided to the developing roller 2033*d*.

As the developing rollers 2033*a* through 2033*d* rotate, the toner of four colors is applied onto the surfaces of the photoconductor drums 2030*a* through 2030*d* from the respective toner cartridges 2034*a* through 2034*d*. Here, upon making contact with the surfaces of the respective photoconductor drums 2030*a* through 2030*d*, some of the toner provided in the developing rollers 2033*a* through 2033*d* is attached onto the photoconductor drums 2030*a* through 2030*d*. That is to say, the toner is attached onto the surfaces of the respective photoconductor drums 2030*a* through 2030*d* on the regions which have been irradiated with the light emitted by the light sources. In other words, toner is attached onto the latent images formed on the surfaces of the photoconductor drums 2030*a* through 2030*d* by the respective developing rollers 2033*a* through 2033*d*, in order to actualize the latent images. Then, images formed by the attached toner, or so-called toner images, are transferred to the transfer belt 2040 as the respective photoconductor drums 2030*a* through 2030*d* rotate. In such a way, charging, forming a latent image, and transferring the latent image are performed with respect to each color. Here, the toner images of black, cyan, magenta, and yellow are transferred in order onto the transfer belt 2040 at predetermined timings, respectively. In such a way, the toner images are superimposed as the toner images of four colors are transferred. A color image is formed in such a way.

Meanwhile, the paper feeding tray 2060 stores recording media such as papers, etc. The paper feeding roller 2054 is arranged near the paper feeding tray 2060. The paper feeding roller 2054 takes papers out of the paper feeding tray 2060 one by one. Then, the paper is conveyed to the registration roller pair 2056, upon having been taken out of the paper feeding tray 2060. Then, the registration roller pair 2056 conveys the paper through the transfer belt 2040 and the transfer roller 2042 at a predetermined timing. In such a way, the color image formed on the transfer belt 2040 is transferred onto the conveyed paper, etc. Then, the paper with the transferred color image is conveyed to the fixing roller 2050.

The fixing roller 2050 applies heat and pressure to the paper. Here, the toner of the color image transferred on the paper is fixed due to the applied heat and pressure. Then, after the toner is fixed, the paper is conveyed through the paper ejection roller 2058 to the paper ejection tray 2070. The paper is stacked on the paper ejection tray 2070 one by one.

Furthermore, the cleaning units 2031*a* through 2031*d* remove toner that is left on the surfaces of the photoconductor drums 2030*a* through 2030*d*, or so-called residual toner, respectively. After the residual toner is removed in such a way, the photoconductor drums 2030*a* through 2030*d* rotate back to positions where the surfaces from which toner is removed respectively face the charging devices 2032*a* through 2032*d*. Then, the color printer 2000 may proceed to form more images.

The color printer 2000 includes home position sensors 2246*a* through 2246*d* provided on the respective photoconductor drums 2030*a* through 2030*d*, so as to detect predetermined positions of the photoconductor drums 2030*a* through 2030*d* (hereinafter referred to as home positions).

Figure 2:
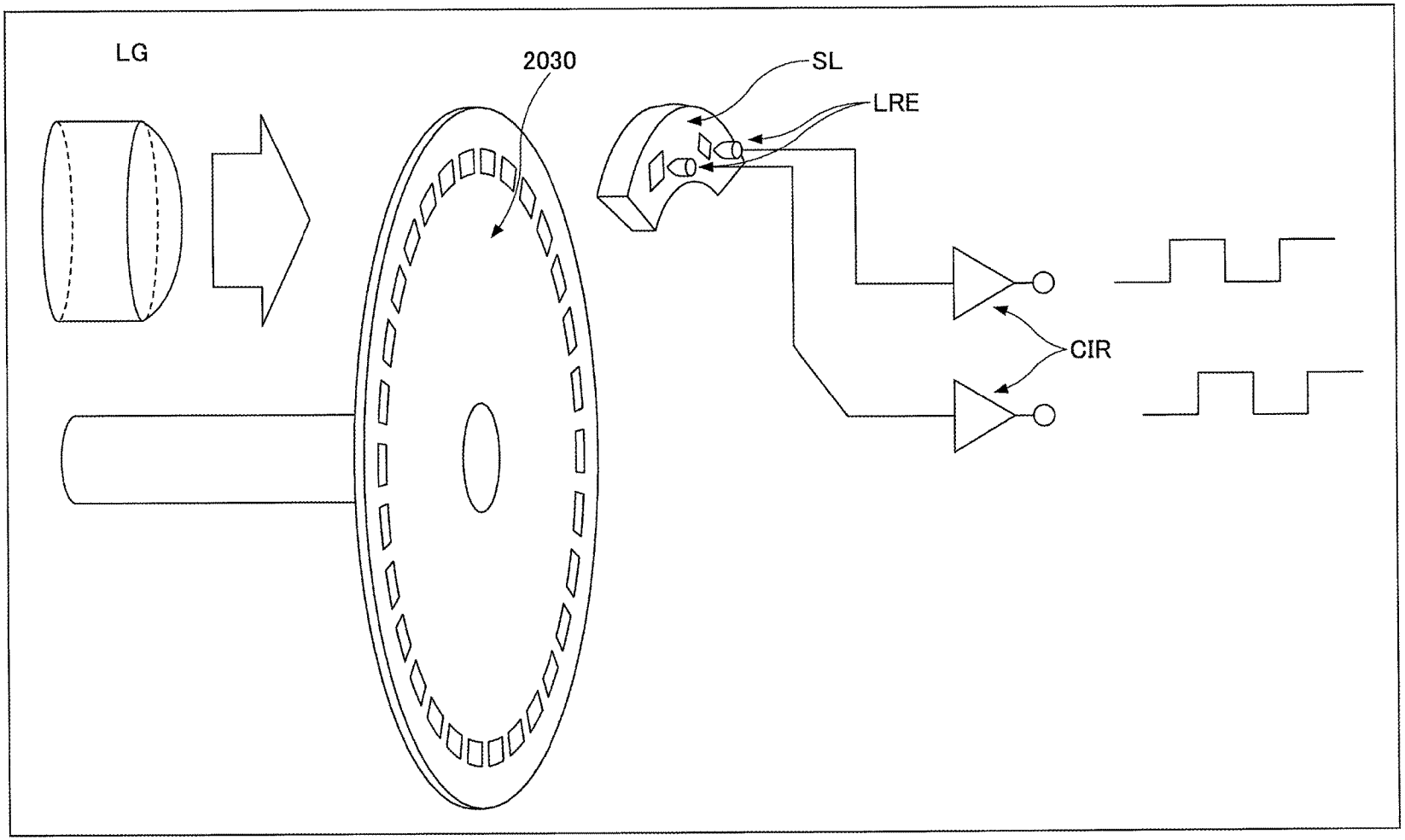
FIG. 2 is a drawing illustrating an example of a position sensor, according to the embodiment of the present invention.

FIG. 2 is a drawing illustrating an example of a position sensor, according to the embodiment of the present invention. As illustrated in FIG. 2, the position sensor includes a light source LG such as a light emitting diode (LED), a fixed slit SL, a light receiving element LRE, a wave forming circuit CIR, etc. In the illustrated example, the photoconductor drum 2030 has holes, so that light emitted by the light source LG is transmitted through a hole and the fixed slit SL and then detected by the light receiving element LRE. A detection result is output as a waveform by the wave forming circuit CIR, as illustrated in FIG. 2. Here, although the light receiving element LRE detects transmitted light according to the illustrated configuration, the light receiving element LRE may detect reflected light, etc.

Alternatively, a mark, a bump, etc., may be provided on the photoconductor drum 2030 so that the home position is indicated. Based on such a mark, etc., a rotation of the photoconductor drum 2030 may be detected. The color printer 2000 may detect that the photoconductor drum 2030 rotates from the home position back to the home position, based on detection of the mark, etc. Here, the home position sensor may detect the home position in an electronical and/or a mechanical way. For example, in a case where the home position is indicated by a bump, etc., the home position sensor may be a touch sensor, etc., which detects the bump, etc., in a mechanical way. On the other hand, in a case where the home position is indicated by a mark, etc., the home position sensor may be an optical sensor, etc., which detects the mark, etc., in an electronic way.

The home positions of the photoconductor drums 2030*a* through 2030*d* are detected by the respective home position sensors 2246*a* through 2246*d* provided in the color printer 2000. Specifically, the home position of the photoconductor drum 2030*a* is detected by the home position sensor 2246*a*. Similarly, the home position of the photoconductor drum 2030*b* is detected by the home position sensor 2246*b*. Further, the home position of the photoconductor drum 2030*c* is detected by the home position sensor 2246*c*. Further, the home position of the photoconductor drum 2030*d* is detected by the home position sensor 2246*d*.

The color printer 2000 includes electric potential sensors on the photoconductor drums 2030*a* through 2030*d* for measuring electric potential on the surfaces of the respective photoconductor drums 2030*a* through 2030*d*. Here, the electric potential sensors are installed, for example, so that the electric potential sensors face the photoconductor drums 2030*a* through 2030*d*, respectively.

<Example of Density Detector>

Figure 3:
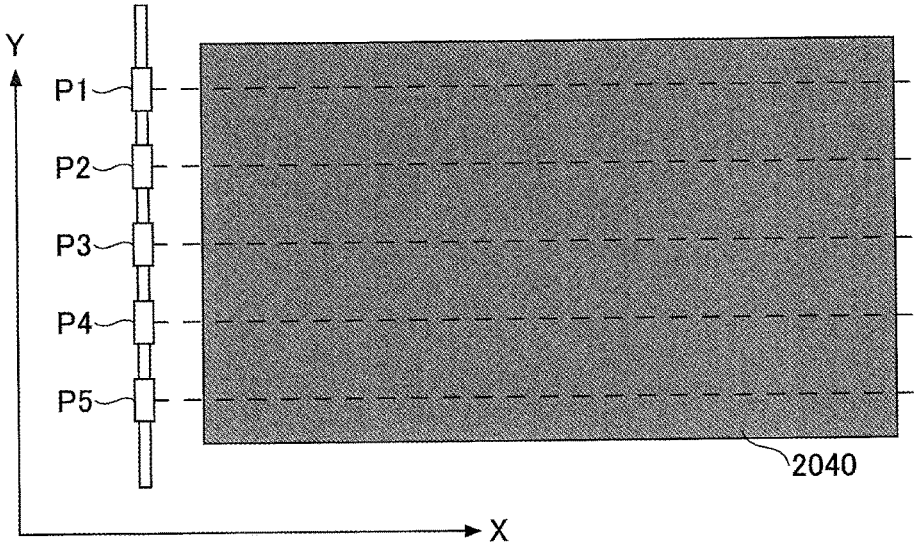
FIG. 3 is a drawing illustrating an example of an installation position of a density detector which detects density of an image, according to the embodiment of the present invention.

FIG. 3 is a drawing illustrating an example of an installation position of the density detector 2245 which detects density of an image, according to the embodiment of the present invention. As an example, the density detector 2245 (see, FIG. 1) includes five optical sensors P1 through P5, as illustrated in FIG. 3. In the following explanation, the example of the density detector 2245 having the five optical sensors P1 through P5 will be discussed. Here, the number of the optical sensors is not limited to five. For example, the density detector 2245 may be formed by three optical sensors.

Further, in the following description, an arbitrary optical sensor may be simply referred to as an optical sensor, without differentiating the optical sensors P1 through P5.

Specifically, the optical sensors P1 through P5 are arranged along the Y-axis, or in the direction orthogonal to the moving direction of the transfer belt 2040, at positions facing the region that corresponds to the effective imaging regions, as illustrated in FIG. 3.

Figure 4:
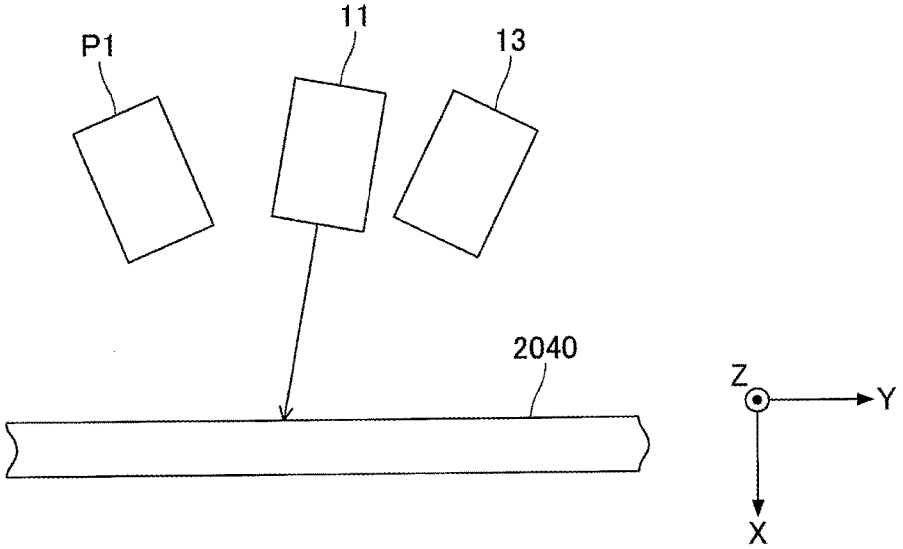
FIG. 4 is a drawing illustrating an example of a method for detecting density of an image, according to the embodiment of the present invention.

FIG. 4 is a drawing illustrating an example of a method for detecting density of an image, according to the embodiment of the present invention. As an example, the density detector 2245 (see, FIG. 1), having the optical sensors P1 through P5 at the positions illustrated in FIG. 3, may detect density as illustrated in FIG. 4. In the following explanation, an example of the optical sensor P1 will be discussed.

The density detector 2245 includes a light source such as an LED 11. First, the LED 11 irradiates the transfer belt 2040 with light. The light is reflected by the transfer belt 2040 or by a toner image formed on the transfer belt 2040. The specular reflection of the light, for example, may be received by the optical sensor P1. Then, the optical sensor P1 outputs a signal indicating intensity of light, based on the received light. That is to say, the color printer 2000 is capable of detecting density of an image based on the signal, which indicates different intensity of light depending on the amount of toner, etc., attached on the transfer belt 2040.

Further, as illustrated in FIG. 4, there may be multiple optical sensors. Specifically, light may be reflected by the transfer belt 2040, etc., as diffuse reflection. Therefore, the color printer 2000 may be provided with an optical sensor 13 for diffuse reflection. Here, upon receiving light, the optical sensor 13 for diffuse reflection outputs a signal indicating intensity of received light, similarly to the optical sensor P1. Specifically, for example, in case of detecting density of a color image, an amount of toner may be calculated based on the specular reflection and the diffuse reflection, whereas in case of detecting density of a black image, an amount of toner may be calculated based on the specular reflection.

<Examples of Optical Scanning Control Device>

Figure 5:
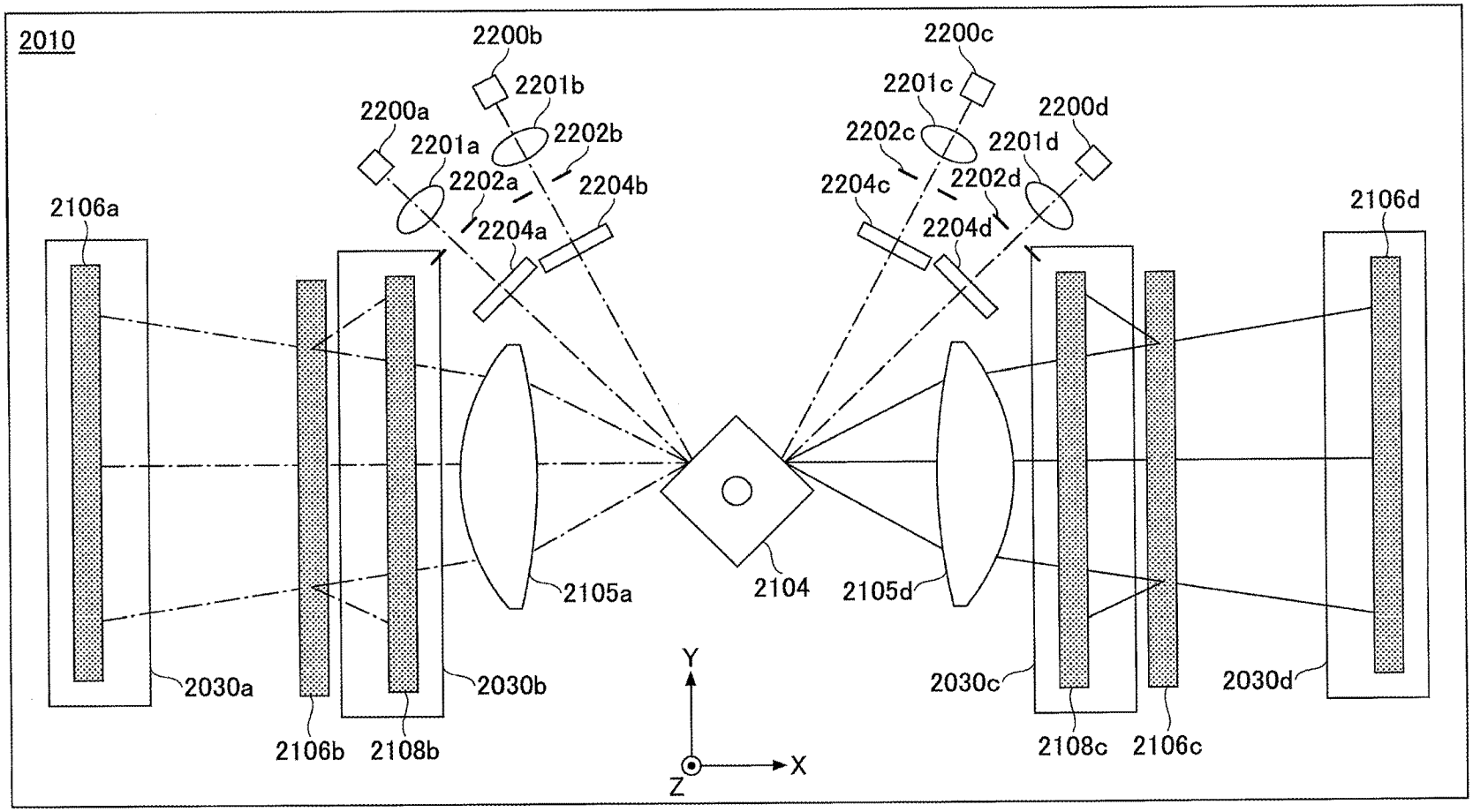
FIG. 5 is a drawing illustrating an example (1) of an optical scanning control device, according to the embodiment of the present invention.

FIG. 5 is a drawing illustrating an example (1) of the optical scanning control device 2010, according to the embodiment of the present invention.

Figure 6:
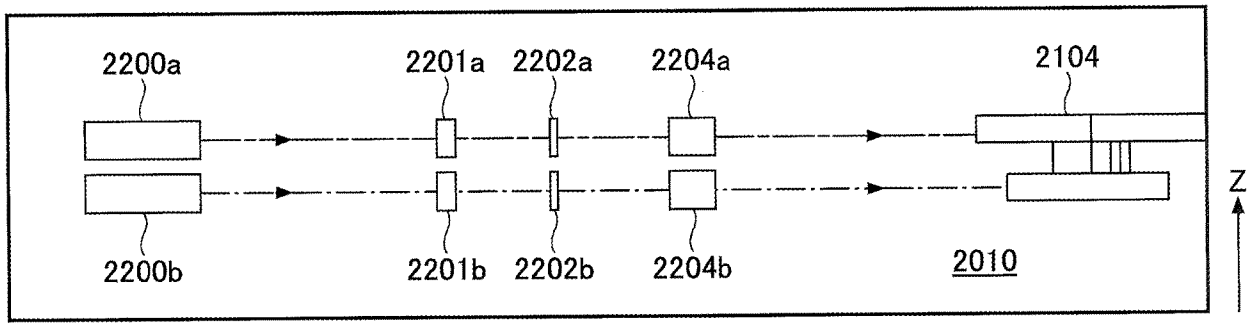
FIG. 6 is a drawing illustrating an example (2) of the optical scanning control device, according to the embodiment of the present invention.
Figure 7:
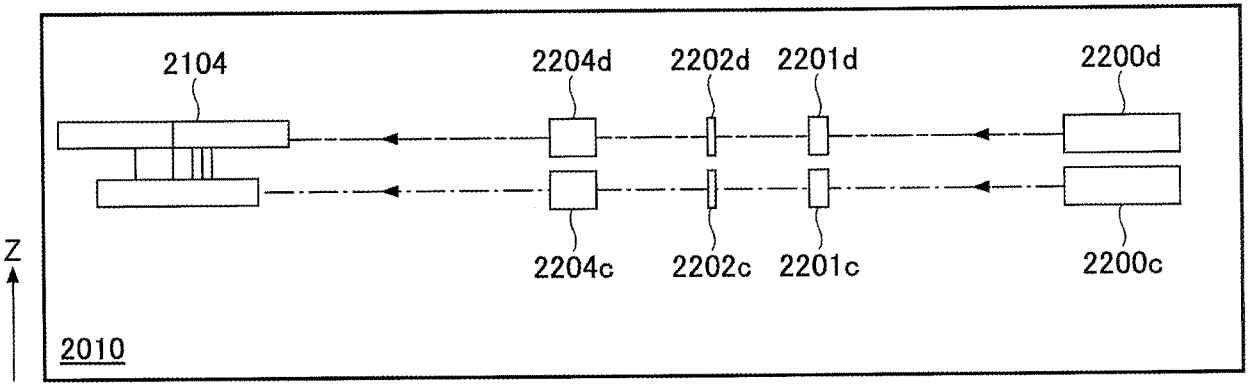
FIG. 7 is a drawing illustrating an example (3) of the optical scanning control device, according to the embodiment of the present invention.
Figure 8:
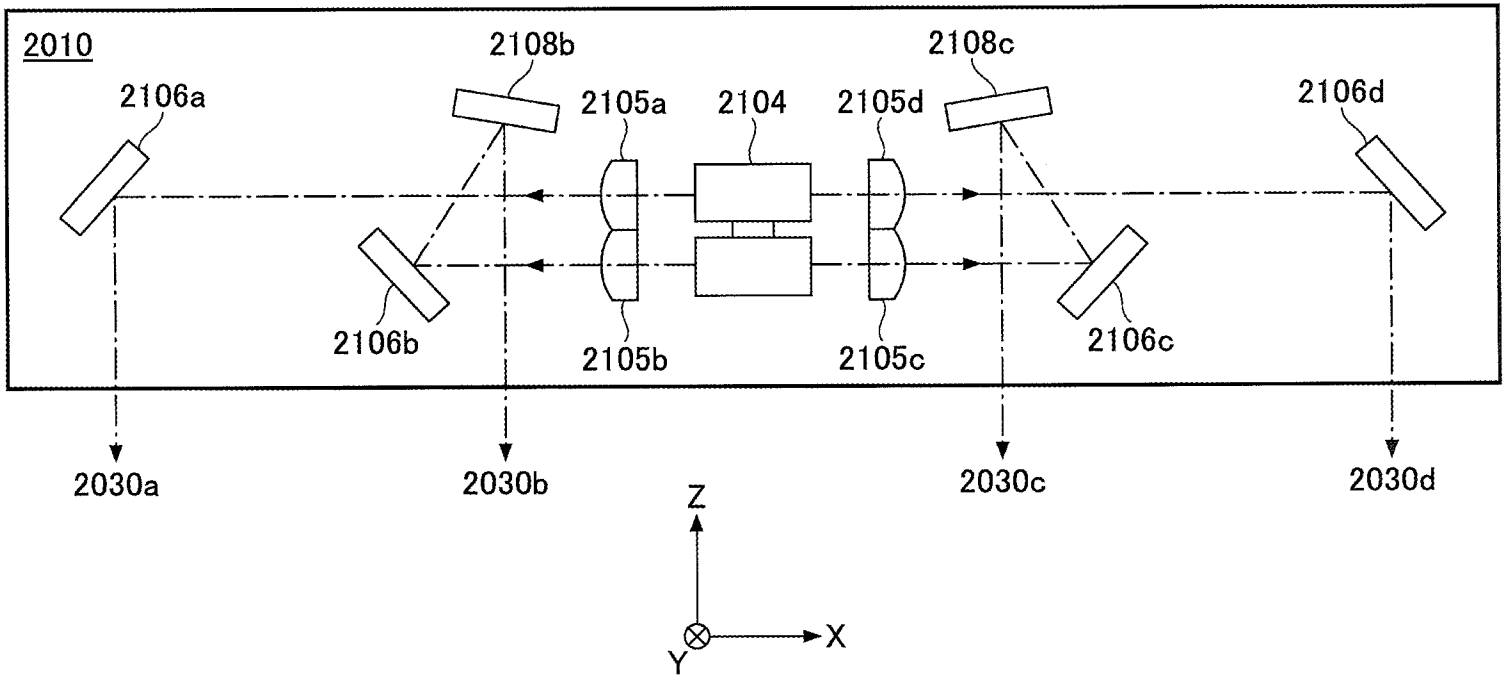
FIG. 8 is a drawing illustrating an example (4) of the optical scanning control device, according to the embodiment of the present invention.

FIG. 6 is a drawing illustrating an example (2) of the optical scanning control device 2010, according to the embodiment of the present invention FIG. 7 is a drawing illustrating an example (3) of the optical scanning control device 2010, according to the embodiment of the present invention FIG. 8 is a drawing illustrating an example (4) of the optical scanning control device 2010, according to the embodiment of the present invention As an example, the optical scanning control device 2010 includes light sources 2200*a* through 2200*d*. Further, the optical scanning control device 2010 includes coupling lenses 2201*a* through 2201*d*. Further, the optical scanning control device 2010 includes aperture plates 2202*a* through 2202*d*. Further, the optical scanning control device 2010 includes cylindrical lenses 2204*a* through 2204*d*. Further, the optical scanning control device 2010 includes a polygon mirror 2104. Further, the optical scanning control device 2010 includes scanning lenses 2105*a* through 2105*d*. Further, the optical scanning control device 2010 includes folding mirrors 2106*a* through 2106*d*, 2108*b*, and 2108*c*.

In the following, an arbitrary light source may be referred to as a light source 2200, without differentiating the light sources 2200*a* through 2200*d*.

The light source 2200 includes a surface-emitting laser array on which, for example, multiple light-emitting parts (e.g. 40 light-emitting parts) are arranged in two dimensions. The multiple light-emitting parts are arranged on the surface-emitting laser array, so that, for example, the multiple light-emitting parts emit light at even intervals in the sub-scanning direction. In other words, the multiple light-emitting parts are arranged at proper intervals at least in the sub-scanning direction. In the following description, a center-to-center distance of two of the multiple light-emitting parts may be referred to as a light-emitting parts distance.

The coupling lens 2201*a* is arranged on a light-path of the luminous flux emitted by the light source 2200*a*. Here, the coupling lens 2201*a* fixes the luminous flux, so as to form completely or almost completely parallel luminous flux. Similarly, the coupling lens 2201*b* is arranged on a light-path of the luminous flux emitted by the light source 2200*b*. Here, the coupling lens 2201*b* fixes the luminous flux, so as to form completely or almost completely parallel luminous flux. Further, the coupling lens 2201*c* is arranged on a light-path of the luminous flux emitted by the light source 2200*c*. Here, the coupling lens 2201*c* fixes the luminous flux, so as to form completely or almost completely parallel luminous flux. Further, the coupling lens 2201*d* is arranged on a light-path of the luminous flux emitted by the light source 2200*d*. Here, the coupling lens 2201*d* fixes the luminous flux, so as to form completely or almost completely parallel luminous flux.

The aperture plate 2202*a*, which has an aperture, fixes the luminous flux passing through the coupling lens 2201*a*. Similarly, the aperture plate 2202*b*, which has an aperture, fixes the luminous flux passing through the coupling lens 2201*b*. Further, the aperture plate 2202*c*, which has an aperture, fixes the luminous flux passing through the coupling lens 2201*c*. Further, the aperture plate 2202*d*, which has an aperture, fixes the luminous flux passing through the coupling lens 2201*d*.

The cylindrical lens 2204*a* focuses, in the Z-axis, the luminous flux passing through the aperture of the aperture plate 2202*a* in proximity to the deflecting surface of the polygon mirror 2104. Similarly, the cylindrical lens 2204*b* focuses, in the Z-axis, the luminous flux passing through the aperture of the aperture plate 2202*b* in proximity to the deflecting surface of the polygon mirror 2104. Further, the cylindrical lens 2204*c* focuses, in the Z-axis, the luminous flux passing through the aperture of the aperture plate 2202*c* in proximity to the deflecting surface of the polygon mirror 2104. Further, the cylindrical lens 2204*d* focuses, in the Z-axis, the luminous flux passing through the aperture of the aperture plate 2202*d* in proximity to the deflecting surface of the polygon mirror 2104.

The optical system, having the coupling lens 2201*a*, the aperture plate 2202*a*, and the cylindrical lens 2204*a*, is referred to as a pre-deflector optical system of the K-station. Similarly, the optical system, having the coupling lens 2201*b*, the aperture plate 2202*b*, and the cylindrical lens 2204*b*, is referred to as a pre-deflector optical system of the C-station. Further, the optical system, having the coupling lens 2201*c*, the aperture plate 2202*c*, and the cylindrical lens 2204*c*, is referred to as a pre-deflector optical system of the M-station. Further, the optical system, having the coupling lens 2201*d*, the aperture plate 2202*d*, and the cylindrical lens 2204*d*, is referred to as a pre-deflector optical system of the Y-station.

The polygon mirror 2104 rotates around the Z-axis. Furthermore, the polygon mirror 2104 has a two-level structure, as illustrated in FIG. 6, etc. Further, the polygon mirror 2104 has a four-sided mirror. The polygon mirror 2104, having the four-sided mirror, functions as deflection surfaces for each of the luminous flux. The four-sided mirror of the first level deflects the luminous flux passing through the cylindrical lenses 2204*b* and 2204*c*, whereas the four-sided mirror of the second level deflects the luminous flux passing through the cylindrical lenses 2204*a* and 2204*d*. Here, the luminous flux passing through the cylindrical lenses 2204*a* and 2204*b* are deflected towards the "−" direction in the X-axis, viewed from the position of the polygon mirror 2104, whereas the luminous flux passing through the cylindrical lenses 2204*c* and 2204*d* are deflected towards the "+" direction in the X-axis, viewed from the position of the polygon mirror 2104.

The scanning lenses 2105*a* through 2105*d* focus the luminous flux onto the respective photoconductor drums 2030*a* through 2030*d*. Furthermore, the luminous flux is controlled, based on the rotation of the polygon mirror 2104, so that light spots move in the main-scanning direction at the constant speed on the surfaces of the respective photoconductor drums 2030*a* through 2030*d*.

Specifically, first of all, the scanning lenses 2105*a* and 2105*b* are arranged to be at the "−" side in the X-axis, viewed from the position of the polygon mirror 2104, whereas the scanning lenses 2105*c* and 2105*d* are arranged to be at the "+" side in the X-axis, viewed from the position of the polygon mirror 2104.

Furthermore, the scanning lenses 2105*a* and 2105*b* are stacked in the Z-axis direction. Further, the scanning lens 2105*b* is arranged so as to face the four-sided mirror of the first level, whereas the scanning lens 2105*a* is arranged so as to face the four-sided mirror of the second level. Similarly, the scanning lenses 2105*c* and 2105*d* are stacked in the Z-axis direction. Further, the scanning lens 2105*c* is arranged so as to face the four-sided mirror of the first level, whereas the scanning lens 2105*d* is arranged so as to face the four-sided mirror of the second level.

The photoconductor drum 2030*a* is irradiated with the luminous flux passing through the cylindrical lens 2204*a*, the scanning lens 2105*a*, and the folding mirror 2106*a*, after being deflected by the polygon mirror 2104. Here, a light spot is formed when the photoconductor drum 2030*a* is irradiated with the luminous flux. The light spot moves in the longitudinal direction of the photoconductor drum 2030*a* as the polygon mirror 2104 rotates. In other words, the light spot scans the photoconductor drum 2030*a* in accordance with the rotation of the polygon mirror 2104.

Here, the scanning direction of the light spot is the main-scanning direction. Thus, the rotating direction of the photoconductor drum 2030*a* is the sub-scanning direction.

Similarly, the photoconductor drum 2030*b* is irradiated with the luminous flux passing through the cylindrical lens 2204*b*, the scanning lens 2105*b*, and the folding mirror 2106*b*, after being deflected by the polygon mirror 2104. Here, a light spot is formed when the photoconductor drum 2030*b* is irradiated with the luminous flux. The light spot moves in the longitudinal direction of the photoconductor drum 2030*b* as the polygon mirror 2104 rotates. In other words, the light spot scans the photoconductor drum 2030*b* in accordance with the rotation of the polygon mirror 2104.

Here, the scanning direction of the light spot is the main-scanning direction. Thus, the rotating direction of the photoconductor drum 2030*b* is the sub-scanning direction.

Similarly, the photoconductor drum 2030*c* is irradiated with the luminous flux passing through the cylindrical lens 2204*c*, the scanning lens 2105*c*, and the folding mirror 2106*c*, after being deflected by the polygon mirror 2104. Here, a light spot is formed when the photoconductor drum 2030*c* is irradiated with the luminous flux. The light spot moves in the longitudinal direction of the photoconductor drum 2030*c* as the polygon mirror 2104 rotates. In other words, the light spot scans the photoconductor drum 2030*c* in accordance with the rotation of the polygon mirror 2104.

Here, the scanning direction of the light spot is the main-scanning direction. Thus, the rotating direction of the photoconductor drum 2030*c* is the sub-scanning direction.

Similarly, the photoconductor drum 2030*d* is irradiated with the luminous flux passing through the cylindrical lens 2204*d*, the scanning lens 2105*d*, and the folding mirror 2106*d*, after being deflected by the polygon mirror 2104. Here, a light spot is formed when the photoconductor drum 2030*d* is irradiated with the luminous flux. The light spot moves in the longitudinal direction of the photoconductor drum 2030*d* as the polygon mirror 2104 rotates. In other words, the light spot scans the photoconductor drum 2030*d* in accordance with the rotation of the polygon mirror 2104.

Here, the scanning direction of the light spot is the main-scanning direction. Thus, the rotating direction of the photoconductor drum 2030*d* is the sub-scanning direction.

Furthermore, the folding mirrors 2106*a* through 2106*d*, 2108*b*, and 2108*c* are arranged, so that the light-path lengths from the polygon mirror 2104 to the respective photoconductor drums 2030 are the same. Further, the folding mirrors 2106*a* through 2106*d*, 2108*b*, and 2108*c* are arranged, so that incident positions and incident angles onto the photoconductor drums 2030 with respect to the respective luminous flux are the same.

The optical systems arranged on the light-paths from the polygon mirror 2104 to the respective photoconductor drums 2030 are referred to as scanning optical systems, etc. Here, the scanning optical system of the K-station includes the scanning lens 2105*a*, the folding mirror 2106*a*, etc. Further, the scanning optical system of the C-station includes the scanning lens 2105*b*, the folding mirrors 2106*b* and 2108*b*, etc. Further, the scanning optical system of the M-station includes the scanning lens 2105*c*, the folding mirrors 2106*c* and 2108*c*, etc. Further, the scanning optical system of the Y-station includes the scanning lens 2105*d*, the folding mirror 2106*d*, etc. Here, there may be multiple scanning lenses in each of the scanning optical systems.

<Example of Hardware Configuration of Optical Scanning Control Device>

Figure 9:
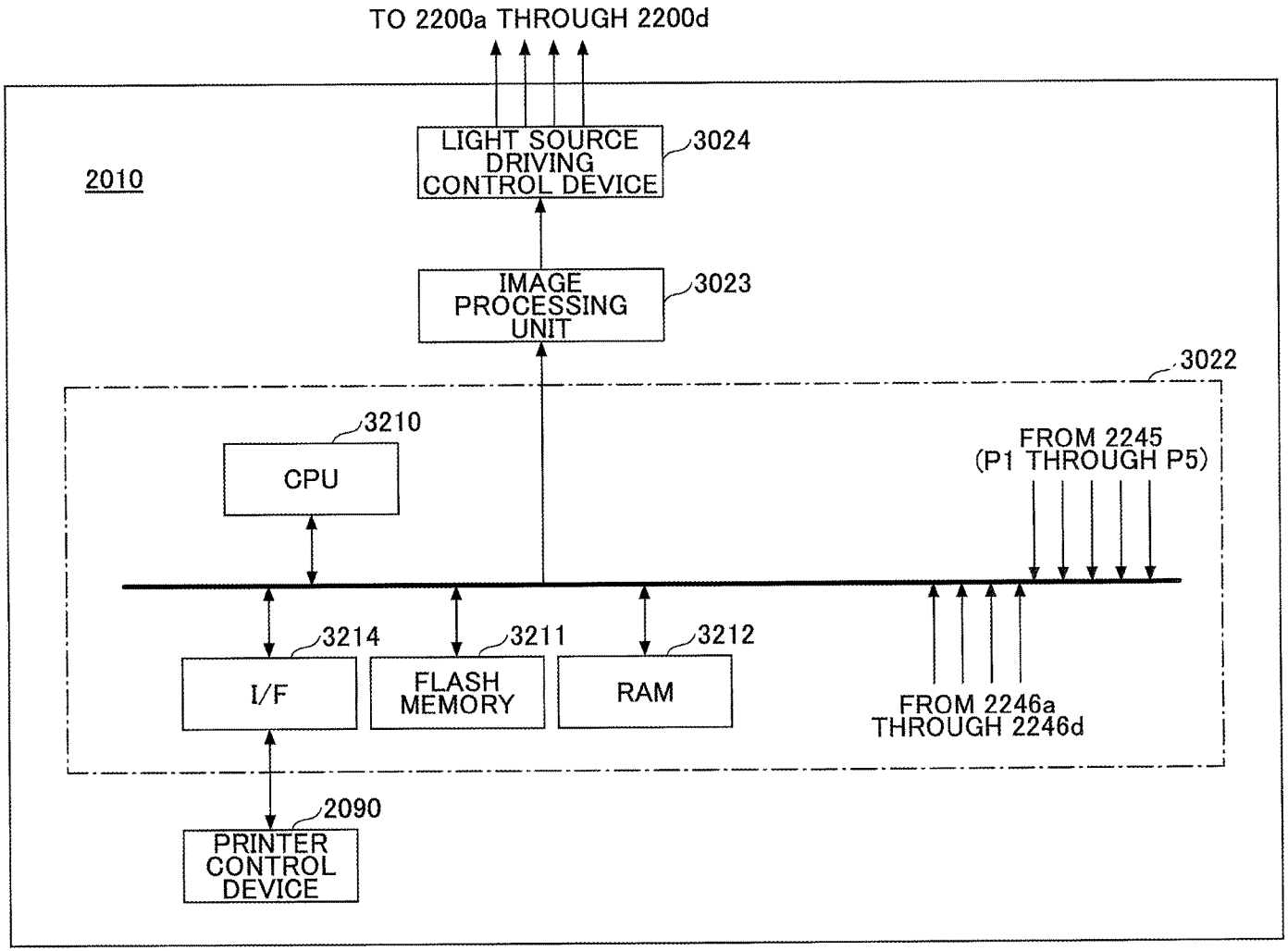
FIG. 9 is a block diagram illustrating an example of a hardware configuration of the optical scanning control device provided in the image forming apparatus, according to the embodiment of the present invention.

FIG. 9 is a block diagram illustrating an example of a hardware configuration of the optical scanning control device 2010 provided in the color printer 2000 (i.e. image forming apparatus), according to the embodiment of the present invention. As illustrated in FIG. 9, the optical scanning control device 2010 includes an interface (I/F) unit 3022, an image processing unit (IPU) 3023, and a light source driving control device 3024.

As illustrated in FIG. 9, the I/F unit 3022 is coupled with the printer control device 2090 and the IPU 3023. To the I/F unit 3022, the printer control device 2090 inputs data transmitted through the communication control device 2080 (see, FIG. 1), in other words, data transmitted by the higher-level device. Here, the input data include image data in the red-green-blue (RGB) system, etc. Further, the I/F unit 3022 transmits the input image data to the IPU 3023 described below.

The IPU 3023 executes image processing. For example, the IPU 3023 receives the image data from the I/F unit 3022, and then converts the image data into data in a color system which are printable in the printing format. Specifically, the IPU 3023 converts the image data in the RGB system, etc., into image data in the tandem system, or CMYK system, etc. Further, the IPU 3023 may execute image processing other than a data system conversion. Then, the IPU 3023 transmits such processed image data to the light source driving control device 3024.

Based on the transmitted image data, the light source driving control device 3024 generates a modulation signal for synchronizing a clock signal indicating timings for emitting light regarding each pixel of the image data. Here, the modulation signal is generated independently with respect to each color. Then, the light source driving control device 3024 transmits the modulation signals to the respective light sources 2200*a* through 2200*d*. Then, the light sources 2200*a* through 2200*d* are driven to emit light in accordance with the respective modulation signals. In such a way, the light source driving control device 3024 controls light emitted from the light sources 2200*a* through 2200*d* towards the respective photoconductor drums 2030*a* through 2030*d*.

The light source driving control device 3024 may be, for example, a single integrated device, etc., which is arranged near the light sources 2200*a* through 2200*d*. Here, it is preferable, in terms of maintenance and replacement, that installation and removal processes may be easier in such a way.

The I/F unit 3022 and the IPU 3023 may be arranged at positions further apart from the light sources 2200*a* through 2200*d*, compared to the light source driving control device 3024. Here, for example, the IPU 3023 and the light source driving control device 3024 may be connected to each other via a cable, etc.

Further, the I/F unit 3022 includes a CPU 3210, a flash memory 3211, a RAM 3212, and an I/F 3214. The hardware items are interconnected to each other via a bus.

The CPU 3210 performs overall operation of the optical scanning control device 2010 in accordance with programs, etc., stored by the flash memory 3211. In other words, the CPU 3210 is an arithmetic device that performs calculation for executing various types of processing and data modification.

The flash memory 3211 stores programs, data, etc., used by the CPU 3210. In other words, the flash memory 3211 is a memory unit.

The RAM 3212 is a memory that provides a work area for the CPU 3210 to execute the programs, etc. In other words, the RAM 3212 is a main memory unit.

The I/F 3214 performs intercommunication with the printer control device 2090. In other words, the I/F 3214 is an input/output unit for inputting and outputting data, etc.

<Example of Functional Configuration of Optical Scanning Control Device>

Figure 10:
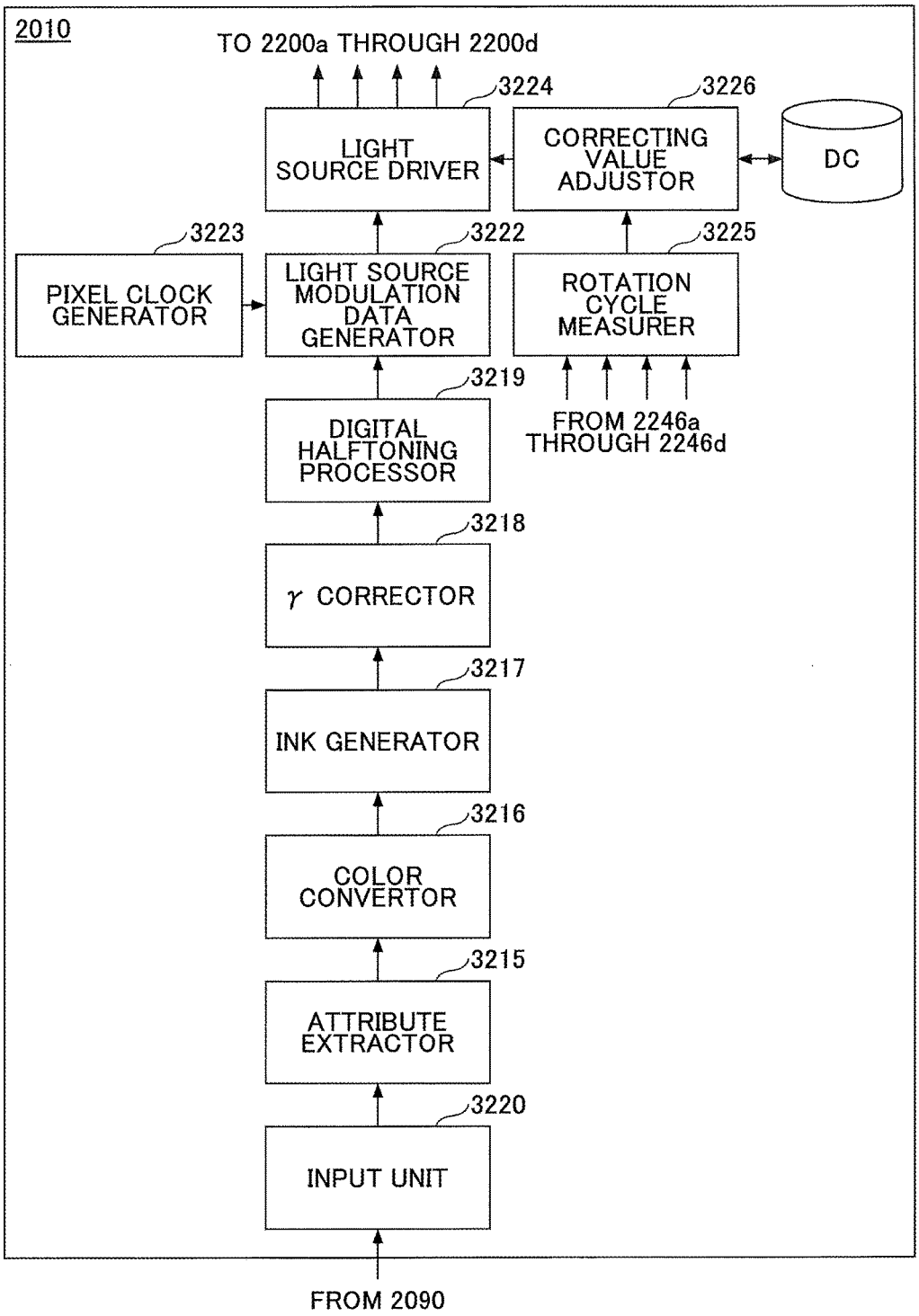
FIG. 10 is a functional block diagram illustrating an example of a functional configuration of the optical scanning control device provided in the image forming apparatus, according to the embodiment of the present invention.

FIG. 10 is a functional block diagram illustrating an example of a functional configuration of the optical scanning control device 2010 provided in the color printer 2000, according to the embodiment of the present invention. As illustrated in FIG. 10, the optical scanning control device 2010 includes an input unit 3220, an attribute extractor 3215, a color convertor 3216, an ink generator 3217, a γ corrector 3218, and a digital halftoning processor 3219. Furthermore, the optical scanning control device 2010 includes a light source modulation data generator 3222, a pixel clock generator 3223, a light source driver 3224, a rotation cycle measurer 3225, and a correcting value adjustor 3226.

The input unit 3220 receives an input of image data, etc., from the printer control device 2090. Here, the input unit 3220 is embodied by the I/F unit 3022 (see, FIG. 9), etc. In the following example, the input image data is at resolution of N, where each pixel is represented by 8-bit data in the RGB system.

The attribute extractor 3215 extracts attribute data from image data. Specifically, each pixel of an input image data may include attribute data that is indicative of attribute. For example, attribute data may be indicative of a type of an object represented in an area by each pixel or a group of pixels. Here, in a case where a pixel is a part of a letter, the attribute is indicative of a "letter". Further, in a case where a pixel is a part of a line, the attribute is indicative of a "line". Further, in a case where a pixel is a part of a figure, the attribute is indicative of a "figure". Further, in a case where a pixel is a part of a photo, the attribute is indicative of a "photo". Such attribute data is extracted by the attribute extractor 3215. After the attribute data is extracted from the image data, the image is transmitted to the color convertor 3216. Here, the transmitted image data is at resolution of N, where each pixel is represented by 8-bit data in the RGB system. Here, the attribute extractor 3215 is embodied by the IPU 3023 (see, FIG. 9), etc.

The color convertor 3216 converts image data in the RGB system into image data in the CMY system. Then, the color convertor 3216 transmits the converted image data to the ink generator 3217. Here, the color convertor 3216 is embodied by the IPU 3023, etc.

The ink generator 3217 generates a black component based on image data in the CMY system, so as to generate image data in the CMYK system. Then, the ink generator 3217 transmits the generated image data to the γ corrector 3218. Here, the ink generator 3217 is embodied by the IPU 3023, etc.

The γ corrector 3218 performs a linear transformation on the γ value of image data in the CMYK system with respect to each color, referring to a lookup table, etc. Then, the γ corrector 3218 transmits the transformed image data to the digital halftoning processor 3219. Here, the γ corrector 3218 is embodied by the IPU 3023, etc.

The digital halftoning processor 3219 decreases the graduation level of the transformed image data, in order to output image data of 1-bit pixels. In other words, the digital halftoning processor 3219 performs halftoning processing such as dithering and error diffusion processing. The digital halftoning processor 3219 performs such processing to convert image data of 8-bit pixels into image data of 1-bit pixels, so that the gradation level is decreased. Through the processing, the digital halftoning processor 3219 generates a screen with regularity (e.g. a halftone screen, a light screen, etc.), in other words, a screen representing a pattern. Then, the digital halftoning processor 3219 transmits the converted image data to the light source modulation data generator 3222. Here, the transmitted image data are at resolution of N, which is represented by 1-bit pixels in the CMYK system. Here, the digital halftoning processor 3219 is embodied by the IPU 3023, etc.

The light source modulation data generator 3222 generates a modulation signal, in other words, a drive signal, based on transmitted image data. Then, the light source modulation data generator 3222 transmits the modulation signal to the light source driver 3224. Here, the light source modulation data generator 3222 is embodied by the light source driving control device 3024 (see, FIG. 9), etc.

The pixel clock generator 3223 generates a pixel clock signal that is indicative of timings for emitting light on pixels. Here, the pixel clock generator 3223 is embodied by the light source driving control device 3024, etc.

The light source driver 3224 drives each of the light sources 2200*a* through 2200*d*, based on a modulation signal. In such a way, the light sources 2200*a* through 2200*d* irradiate the respective photoconductor drums 2030*a* through 2030*d* with light, based on the modulation signal. Here, the light source driver 3224 is embodied by the light source driving control device 3024, etc.

The rotation cycle measurer 3225 measures an interval with respect to each of the home positions, in other words, a rotation cycle, based on a signal indicative of detection of a home position, which is input from each of the home position sensors 2246*a* through 2246*d*. For example, the rotation cycle measurer 3225 measures a rotation cycle, using a counter that counts up based on an internal signal. Specifically, first of all, the rotation cycle measurer 3225 is embodied by a counter, etc., which counts up based on an internal signal. The rotation cycle measurer 3225 measures a time period of a rotation cycle, based on a count value indicated by the counter which starts counting up in response to a signal input by the each of the home position sensors 2246*a* through 2246*d*. The count value is counted up on a basis of a predetermined time period. In such a way, the rotation cycle measurer 3225 counts up a time period from a time of receiving an input of a signal indicative of detection of a home position to the next time of receiving the signal indicative of detection of the home position, in order to measure a rotation cycle. Here, the rotation cycle measurer 3225 is embodied by the I/F unit 3022, light source driving control device 3024, etc.

The correcting value adjustor 3226 corrects a modulation signal, based on correcting data DC. Further, the correcting value adjustor 3226 adjusts a cycle regarding the correction, so that the cycle regarding the correction completely or almost completely matches a measurement result (i.e. a rotation cycle) obtained by the rotation cycle measurer 3225. Here, the correcting value adjustor 3226 is embodied by the light source driving control device 3024, etc. Furthermore, the correcting data DC is stored in a RAM, etc., provided in the light source driving control device 3024, etc.

Here, each processing such as image processing may be partially or entirely performed by hardware such as an electronic circuit, or may be partially or entirely performed by the CPU 3210 based on programs.

<Example of Overall Processing>

Figure 11:
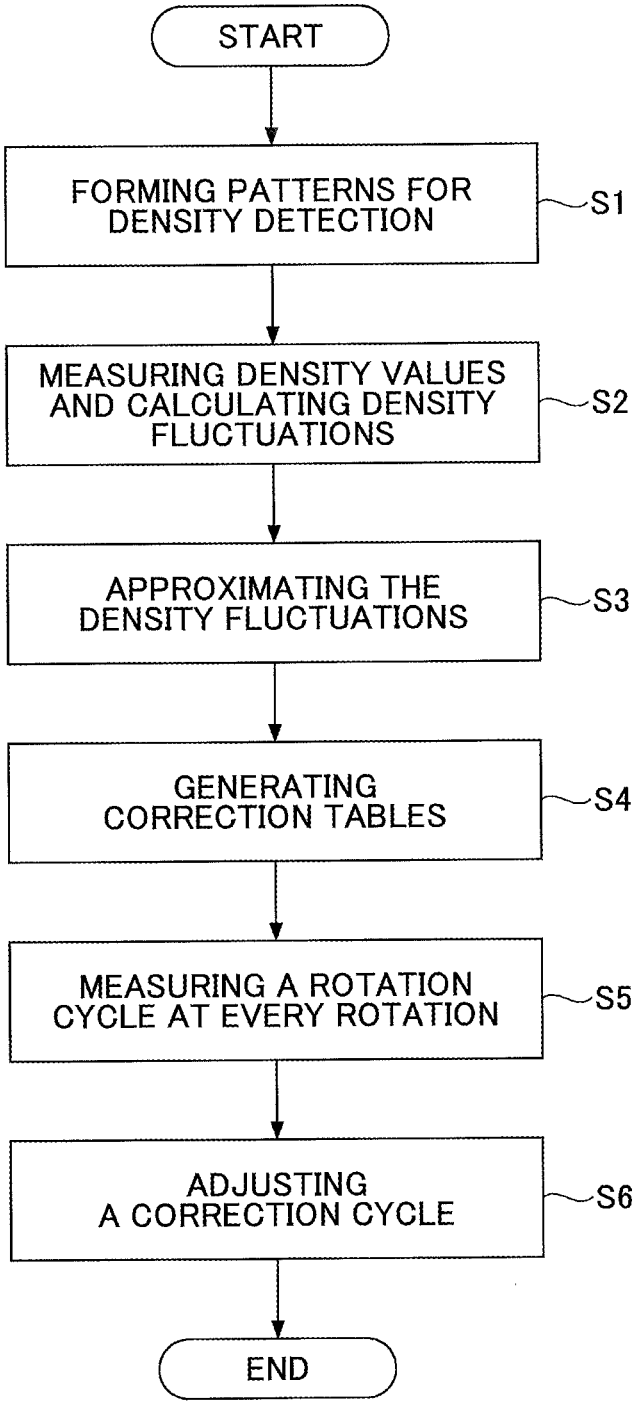
FIG. 11 is a flowchart illustrating an example of overall processing performed by the image forming apparatus, according to the embodiment of the present invention.

FIG. 11 is a flowchart illustrating an example of overall processing performed by the color printer 2000, according to the embodiment of the present invention. Here, the sequence of the overall processing is not limited to as illustrated in FIG. 11. For example, the sequence of the overall processing may not be performed in the same order as illustrated in FIG. 11. Further, parts or all of the sequence may be performed in a parallel, redundant, or separated way.

At Step S1, the color printer 2000 forms patterns PTN for density detection.

Figure 12:
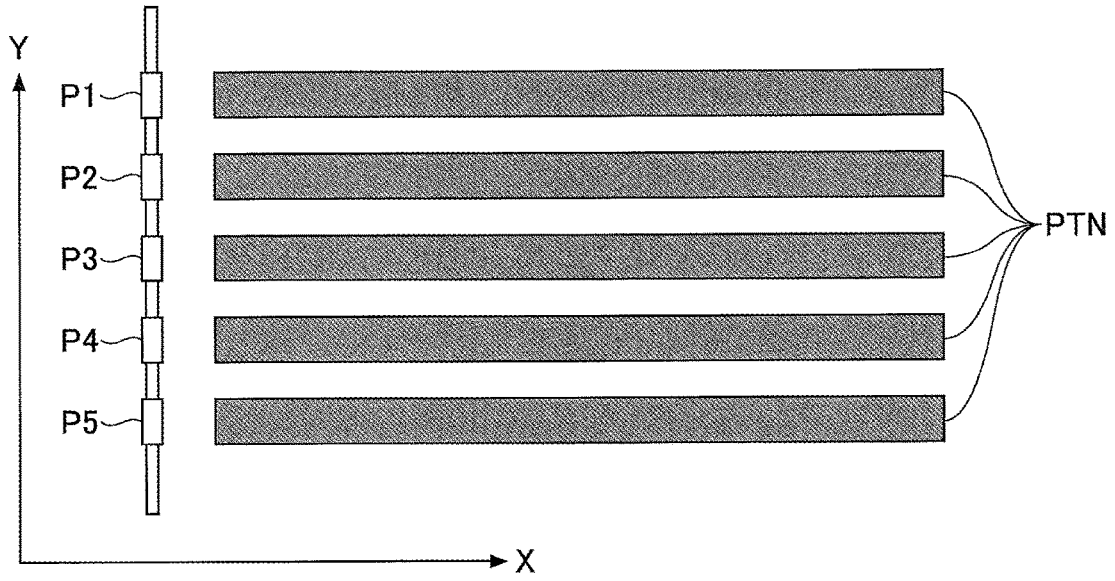
FIG. 12 is a drawing illustrating an example of the patterns for density detection formed by the image forming apparatus, according to the embodiment of the present invention.

FIG. 12 is a drawing illustrating an example of the patterns PTN for density detection formed by the color printer 2000, according to the embodiment of the present invention. At Step S1 of FIG. 11, the color printer 2000 forms the patterns PTN for density detection on the transfer belt 2040 (see, FIG. 1) as illustrated in FIG. 12. Specifically, the color printer 2000 scans a surface of the photoconductor drum 2030 with light of constant intensity. In such a way, the patterns PTN for density detection, which are as long as several rounds of the photoconductor drum 2030, are formed on the transfer belt 2040 as illustrated in FIG. 12. As illustrated in FIG. 12, the patterns PTN for density detection are formed in the X-axis direction, in other words, the sub-scanning direction. Then, the optical sensors P1 through P5 receive light emitted by the LED 11 (see, FIG. 4) towards the patterns PTN for density detection, in such a method as illustrated in FIG. 4.

Returning to FIG. 11, at Step S2, the color printer 2000 measures density values and calculates density fluctuations.

Figure 13:
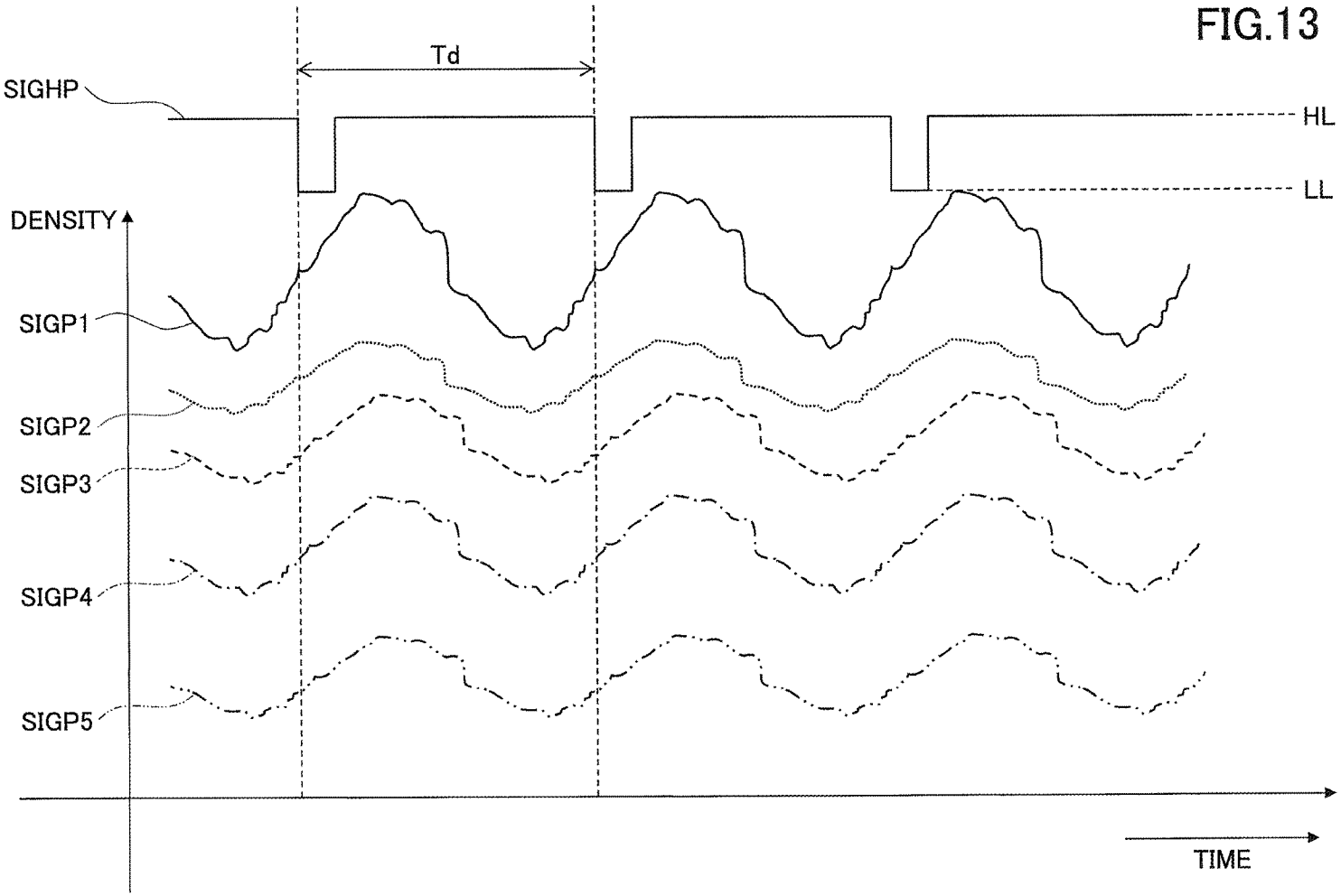
FIG. 13 is a drawing illustrating an example of density values and density fluctuations measured by the image forming apparatus, according to the embodiment of the present invention.

FIG. 13 is a drawing illustrating an example of density values and density fluctuations measured by the color printer 2000, according to the embodiment of the present invention. For example, measured density values are as illustrated in FIG. 13. Furthermore, a signal indicative of home positions (hereinafter referred to as a HP signal SIGHP) which is input by each of the home position sensors 2246*a* through 2246*d* (see, FIG. 1) is illustrated in FIG. 13. Here, the HP signal SIGHP is a so-called active-low signal. That is to say, as illustrated in FIG. 13, the HP signal SIGHP changes to the low level LL upon detection of a home position, although otherwise representing the high level HL.

The color printer 2000 calculates the density values of the patterns PTN for density detection (see, FIG. 12) formed at Step S1 of FIG. 11, based on values that each of the optical sensors P1 through P5 (see, FIG. 12) obtains at a predetermined cycle. For example, the density values are represented by density signals SIGP1 through SIGP5, with respect to the respective optical sensors P1 through P5. In the following example, the calculated density values are as illustrated in FIG. 13.

Here, the calculated density fluctuations are cyclic in the X-axis direction, in other words, the sub-scanning direction. Above all, a drum cycle Td with respect to a photoconductor drum 2030 is calculated. As illustrated in FIG. 13, the drum cycle Td represents an interval of times when the HP signal SIGHP is asserted. That is to say, the drum cycle Td is a period from a time when a home position is detected to the next time when the home position is detected.

Then, fluctuations of density values in the drum cycle Td are calculated. As illustrated in FIG. 13, the density values fluctuate in the same cycles as the drum cycle Td. Thus, density fluctuations in the cycles of the drum cycle Td are calculated.

Further, density differences in the Y-axis, in other words, the main-scanning direction may be calculated. That is to say, differences between each of the optical sensors P1 through P5 may be calculated.

Returning to FIG. 11, at Step S3, the color printer 2000 approximates the density fluctuations.

Figure 14:
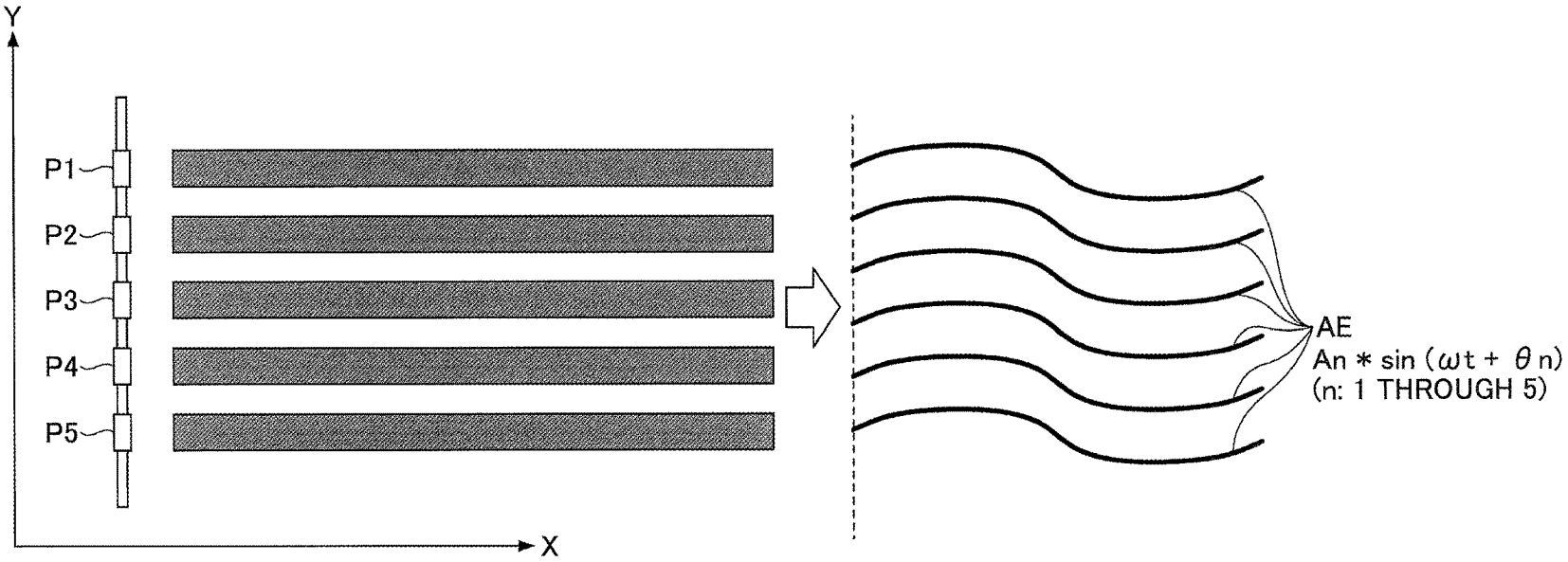
FIG. 14 is a drawing illustrating an example of approximation of the density values performed by the image forming apparatus, according to the embodiment of the present invention.

FIG. 14 is a drawing illustrating an example of approximation of the density values performed by the color printer 2000, according to the embodiment of the present invention. As illustrated in FIG. 14, the color printer 2000 approximates the density values, for example, based on the respective density signals SIGP1 through SIGP5 (see, FIG. 13) by use of a sine function. As illustrated in FIG. 14, each of the density values is approximated by use of such an approximation equation AE as "An*sin (ωt+θn)". Here, "n" in the approximation equation AE is through 5, corresponding to the density signals SIGP1 through SIGP5.

Returning to FIG. 11, at Step S4, the color printer 2000 generates correction tables.

Figure 15:
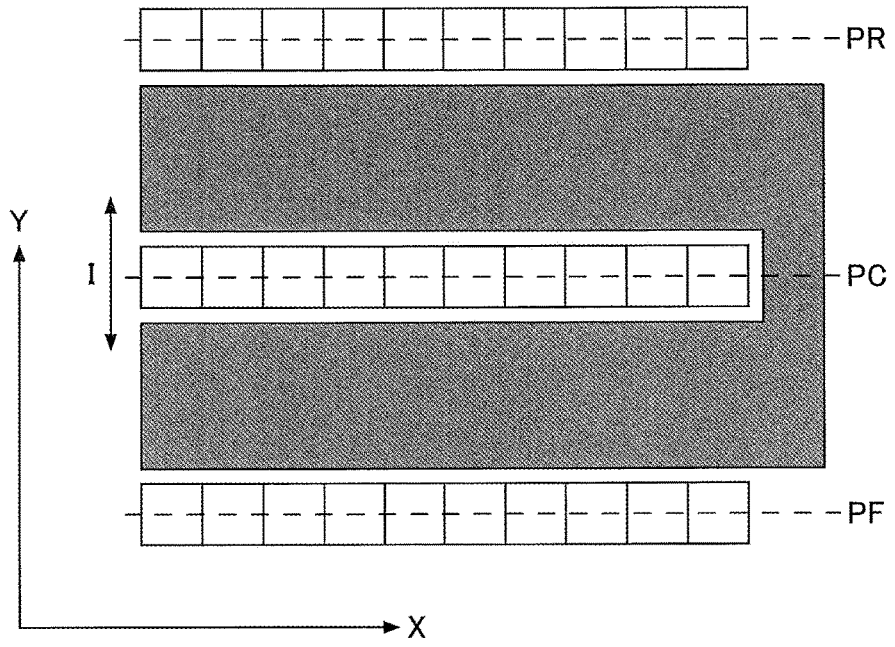
FIG. 15 is a drawing illustrating an example of positions on which corrections are performed based on correction tables generated by the image forming apparatus, according to the embodiment of the present invention.

FIG. 15 is a drawing illustrating an example of positions on which corrections are performed based on correction tables generated by the color printer 2000, according to the present invention. As an example, corrections in the Y-axis, in other words, the main-scanning direction are performed on a front position PF, a center position PC, and a rear position PR. In such an example, three sets of correction tables are generated. Here, the positions are not limited to the front position PF, the center position PC, and the rear position PR. For example, the center position PC may be moved to and set on any other positions, so as to improve density of a page.

Each of the generated correction tables moderates density fluctuations in the X-axis direction, or the sub-scanning direction. First, a cycle of density fluctuation, obtained by use of the approximation equation AE (see, FIG. 14), is converted into a set of correction tables corresponding to a rotation cycle of the photoconductor drum 2030.

Figure 16:
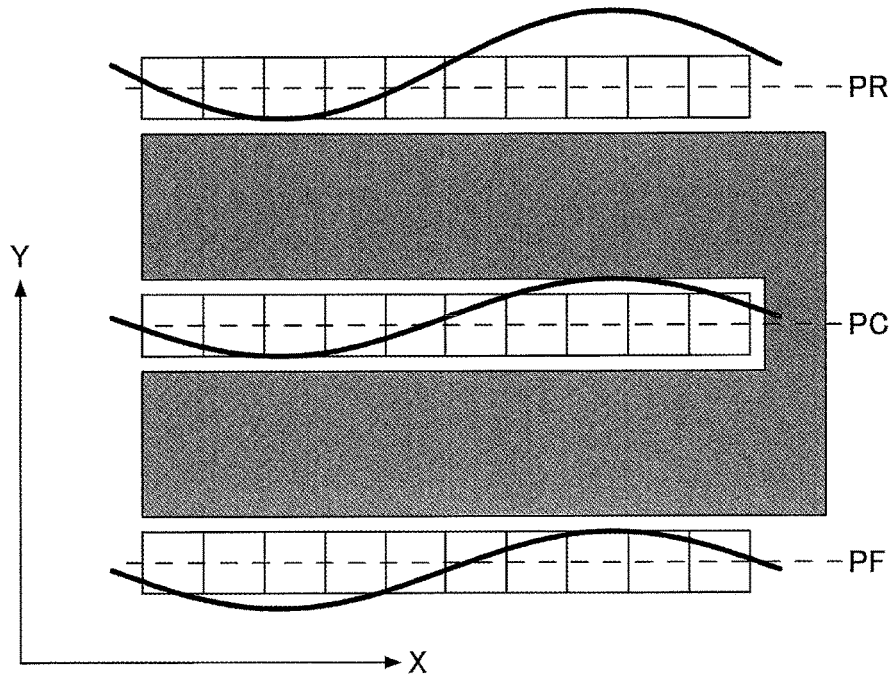
FIG. 16 is a drawing illustrating an example of relations of the correction tables generated by the image forming apparatus to an approximation equation, according to the embodiment of the present invention.

FIG. 16 is a drawing illustrating an example of relations of the correction tables generated by the color printer 2000 to the approximation equation AE, according to the embodiment of the present invention. As illustrated in FIG. 16, cycles of respective density fluctuations are converted into the sets of correction tables having the same cycles as the rotation cycle of the photoconductor drum 2030. Here, in the example, the cycles of the converted correction tables have patterns, on which the phases are shifted by 180 degrees from the phases of the density fluctuations, respectively.

Figure 17:
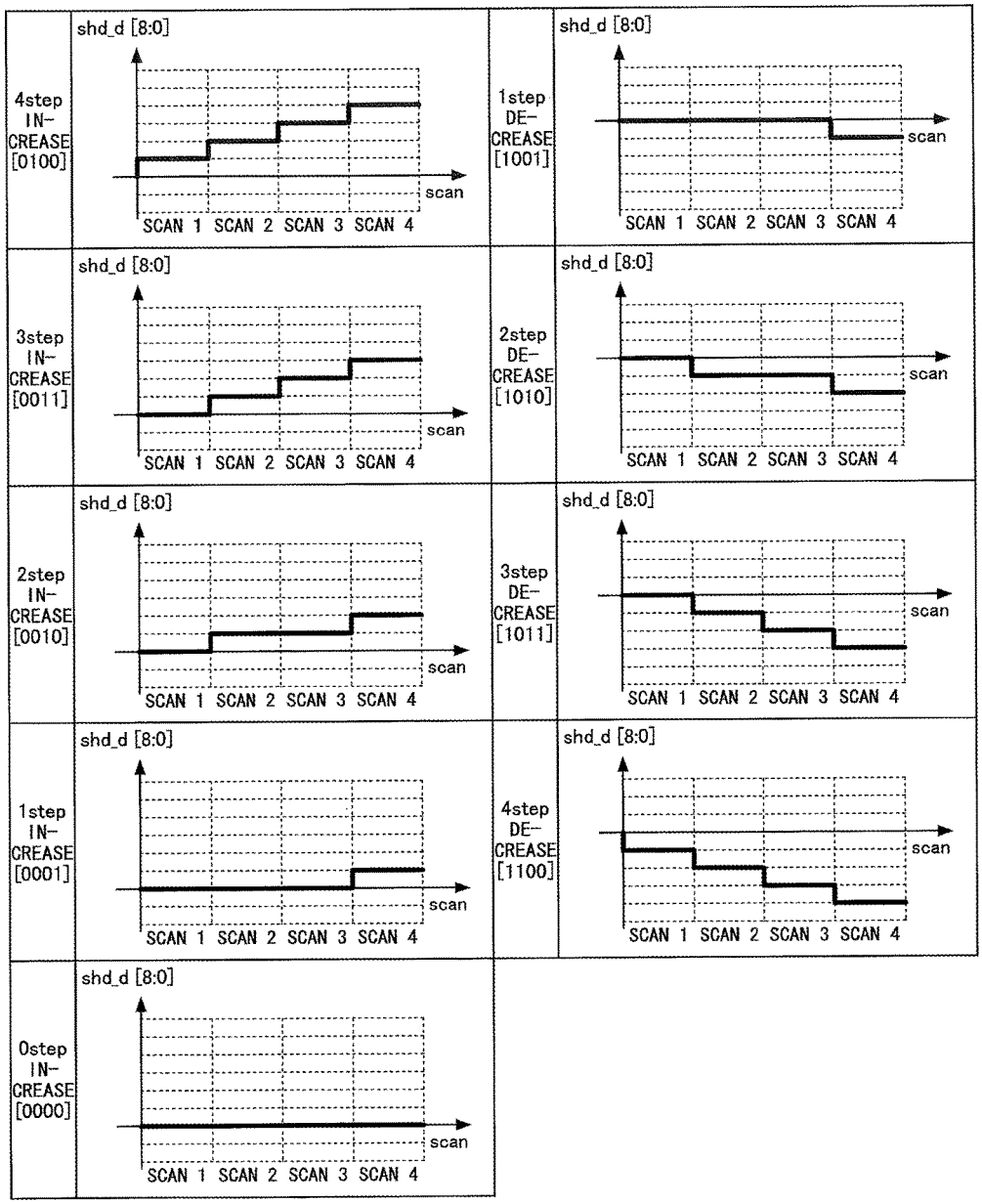
FIG. 17 is a drawing illustrating an example of the correction tables generated by the image forming apparatus, according to the embodiment of the present invention.

FIG. 17 is a drawing illustrating an example of the correction tables generated by the color printer 2000, according to the embodiment of the present invention. In the example, an amount of change compared to a previous scan is input to the correction table. In other words, a difference from the previous scan is input to the correction table. Here, in the example, the amounts of change illustrated in the correction tables are correction values, respectively.

In FIG. 17, the number of scans is indicated in the horizontal axis. Here, in FIG. 17, the left end is indicative of the first scan (hereinafter referred to as a "first scan SCAN1"). Then, the second scale from the left end is indicative of the second scan (hereinafter referred to as a "second scan SCAN2"), which follows the first scan SCAN1. Similarly, a third scan SCAN3 follows the second scan SCAN2. Then, a fourth scan SCAN4 follows the third scan SCAN3.

On the other hand, in FIG. 17, the number of steps is indicated in the vertical direction. For example, the light intensity increases as the number of steps increases. Here, a changeable amount of the light intensity from a scan to the next scan is predetermined. For example, according to a correction table "4step INCREASE [0100]", the light intensity is increased by one step at the first scan SCAN1. Then, the light intensity is increased to the second step at the second scan SCAN2. In such a way, according to the correction table "4step INCREASE [0100]", the light intensity is increased by four steps in four scans in total, being increased by one step at each of the four scans.

Here, in a preferable format of the correction tables, inputs are the amounts of change as illustrated in FIG. 17. Generally, values which indicate respective amounts of change, such as "0", "1", or "2", consist of small data. Therefore, data volumes of the correction tables may be smaller in the format where inputs are the amounts of change, compared to a format where inputs are absolute values, as data volumes of the respective values may be smaller.

Furthermore, an amount of change from a scan to the next scan on a correction table is preferably as small as 0, ±1, or ±2. That is to say, the amount of change is preferably as small as the smallest value of resolution levels. An abrupt change between two scans may deteriorate the quality of an image, due to abrupt changes in pixels. Thus, the quality of a formed image may be improved when the respective amounts of change on the correction tables are small.

Furthermore, as illustrated in FIG. 17, the correction tables need not have data at every scan. For example, the correction tables may have data per multiple scans. Here, in a case where the correction tables have data per multiple scans, the data volumes of the correction tables may be smaller.

Returning to FIG. 11, at Step S5, the color printer 2000 measures a rotation cycle at each rotation.

Figure 18A:
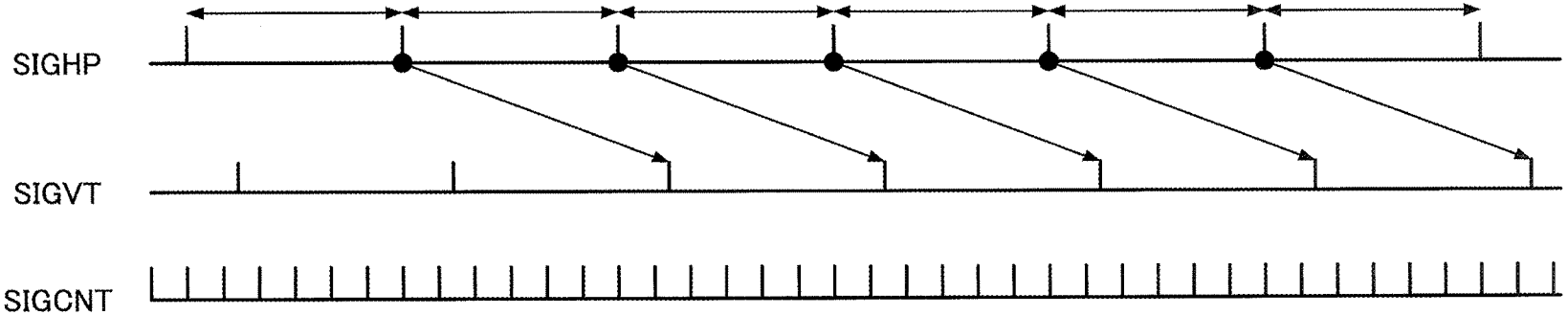
FIGS. 18A and 18B are timing charts illustrating examples of rotation cycles measured by the image forming apparatus, according to the embodiment of the present invention.
Figure 18B:
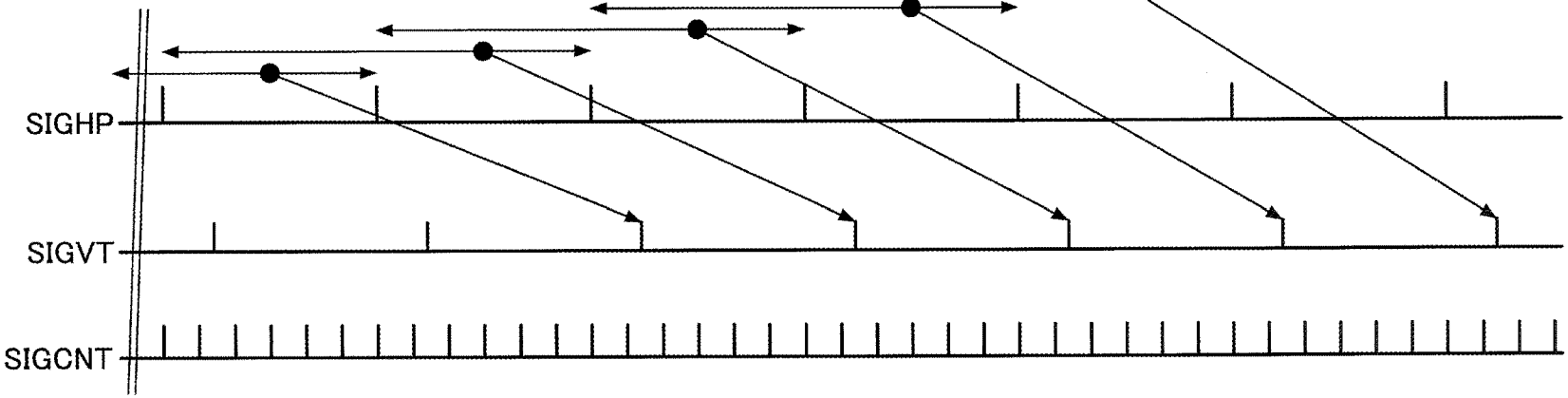

FIGS. 18A and 18B are timing charts illustrating examples of rotation cycles measured by the color printer 2000, according to the embodiment of the present invention. For example, the rotation cycles are measured as illustrated in FIGS. 18A and 18B.

The color printer 2000 measures a cycle of the HP signal SIGHP at each rotation. For the measurement, the color printer 2000 counts up the number of cycles of the counter signal SIGCNT. The counter signal SIGCNT may be a signal of a scanning cycle divided equally, for example, into a tenth, based on the time period.

Specifically, in FIG. 18A, the number of cycles of counter signal SIGCNT is counted up at each rotation for the purpose of measuring the cycle of the HP signal SIGHP. Then, a counted value is reflected on a signal (hereinafter referred to as a "virtual cycle signal SIGVT") as a measurement result. As illustrated in FIGS. 18A and 18B, the measurement results are reflected on the virtual cycle signal SIGVT for the sake of following scans.

Further, an average value or a movement average value of multiple cycles may be reflected on the virtual cycle signal SIGVT, as illustrated in FIG. 18B. For example, a measurement result of two or four cycles may be reflected on the virtual cycle signal SIGVT. Here, in a case where there are not enough measurement results for calculating a movement average value of a predetermined number of cycles, such as two or four cycles, a value obtained in the first cycle may be substituted. For example, in a case where a movement average value of four cycles is supposed to be calculated and where measurement results of only three cycles have been obtained, the movement average value may be calculated by summing up a double value of the first cycle and values of the second and third cycles, and then dividing the sum by 4.

Further, as a counted value generally may not be loaded unless counting of the HP signal SIGHP is not completed, a shift value (e.g. an amount of delay equivalent to four, eight, or twelve scans) may be provided as an allowance of counts.

Returning to FIG. 11, at Step S6, the color printer 2000 corrects a correction cycle.

Figure 19:
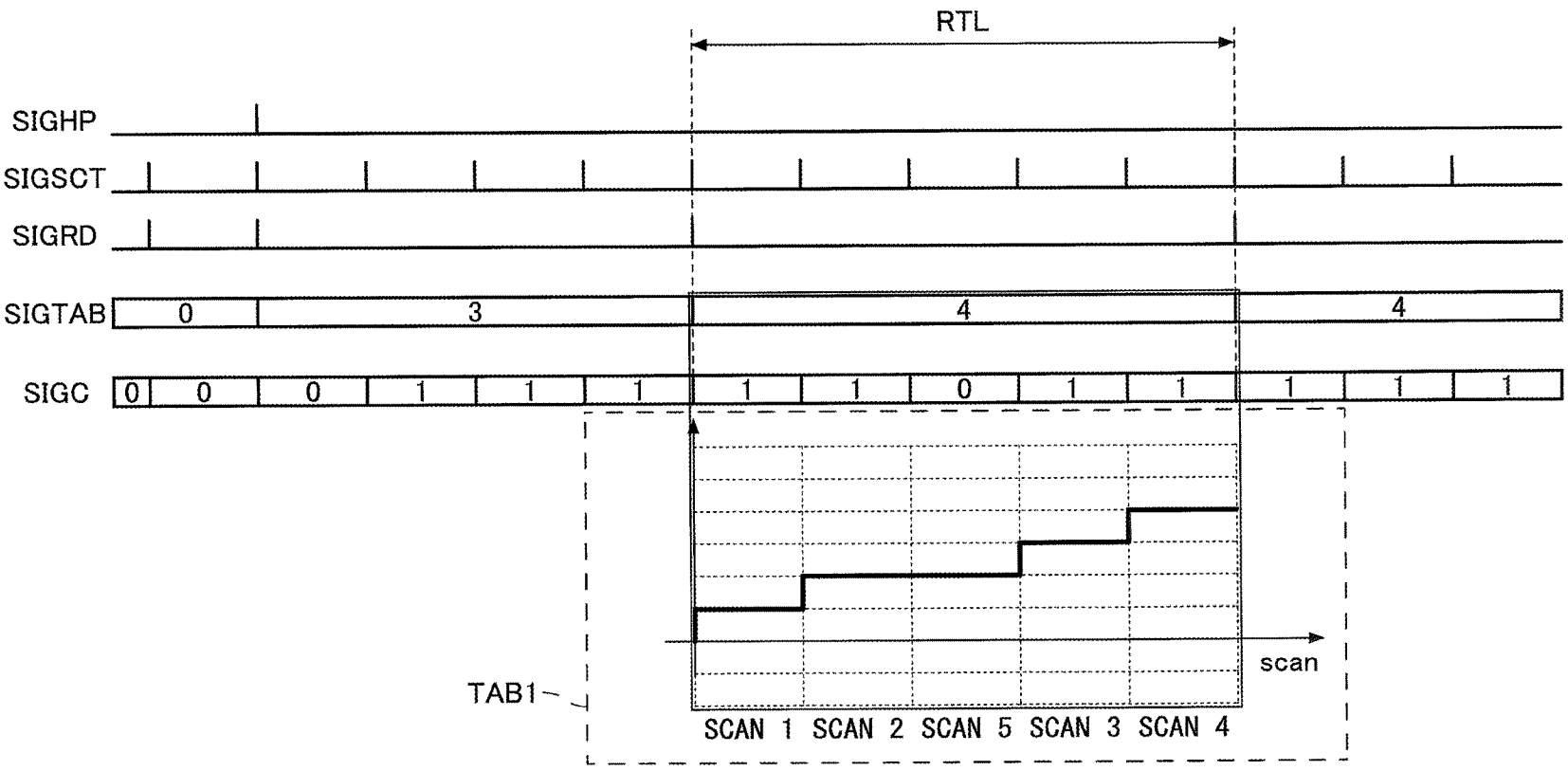
FIG. 19 is a timing chart illustrating an example of a correction cycle corrected by the image forming apparatus, according to the embodiment of the present invention.

FIG. 19 is a timing chart illustrating an example of a correction cycle corrected by the color printer 2000, according to the embodiment of the present invention. In the following example of correcting the correction cycle, a rotation cycle is long. Here, in the example, the correction table is based on the data as illustrated in FIG. 17.

As illustrated in FIG. 17, the correction table includes correcting values of four scans as inputs. That is to say, in the example, the correction cycle consists of four cycles.

On the other hand, the rotation cycle may be longer, as illustrated in FIG. 19 (hereinafter referred to as a "first rotation cycle RTL"). In the example of FIG. 19, the first rotation cycle RTL consists of five cycles of a scanning signal SIGSCT. That is to say, scanning is performed five times.

In a case where the rotation cycle is long, as exemplified by the first rotation cycle RTL, the color printer 2000 modifies the correction table as an adjustment. Specifically, the color printer 2000 modifies the correction table, so that the correction table includes five scans (hereinafter referred to as a "first correction table TAB1"), as illustrated in FIG. 19. The first correction table TAB1 is different from the correction tables illustrated in FIG. 17 in the way that a fifth scan SCAN5 is inserted in between the second scan SCAN2 and the third scan SCAN3. Here, as an adjustment, the fifth scan SCAN5 which is indicative of the same step as the second scan SCAN2 is inserted, so that the correction table includes five scans. In such a way, the color printer 2000 corrects the correction table, so that the light intensity is increased by four steps in five scans.

Figure 20:
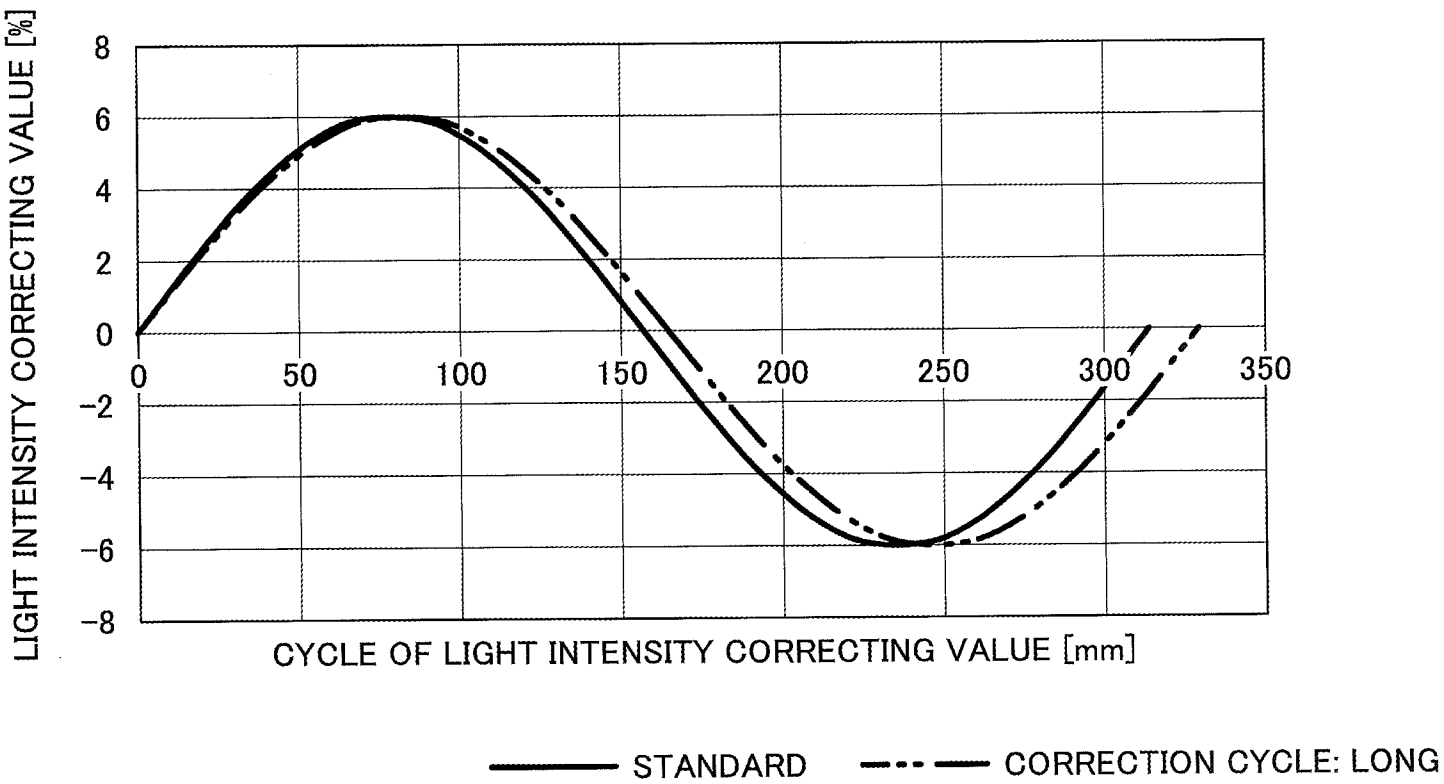
FIG. 20 is a drawing illustrating an example of a result of an adjustment of the correction cycle performed by the image forming apparatus, according to the embodiment of the present invention.

FIG. 20 is a drawing illustrating an example of a result of an adjustment of the correction cycle performed by the color printer 2000, according to the embodiment of the present invention. In the example of FIG. 20, "STANDARD" is indicative of the correction cycles including four scans, where the correction tables illustrated in FIG. 17 are utilized. On the other hand, "CORRECTION CYCLE: LONG" is indicative of the correction cycles, where the first correction tables TAB1 as illustrated in FIG. 19 are utilized. As illustrated in FIG. 20, the correction cycles of "CORRECTION CYCLE: LONG" are longer than the correction cycles of "STANDARD", due to the adjustments. That is to say, even in a case where the rotation cycle is long, the color printer 2000 is capable of lengthening the correction cycle through the adjustment as illustrated in FIG. 19, so that the correction cycle completely or almost completely matches the rotation cycle.

Figure 21:
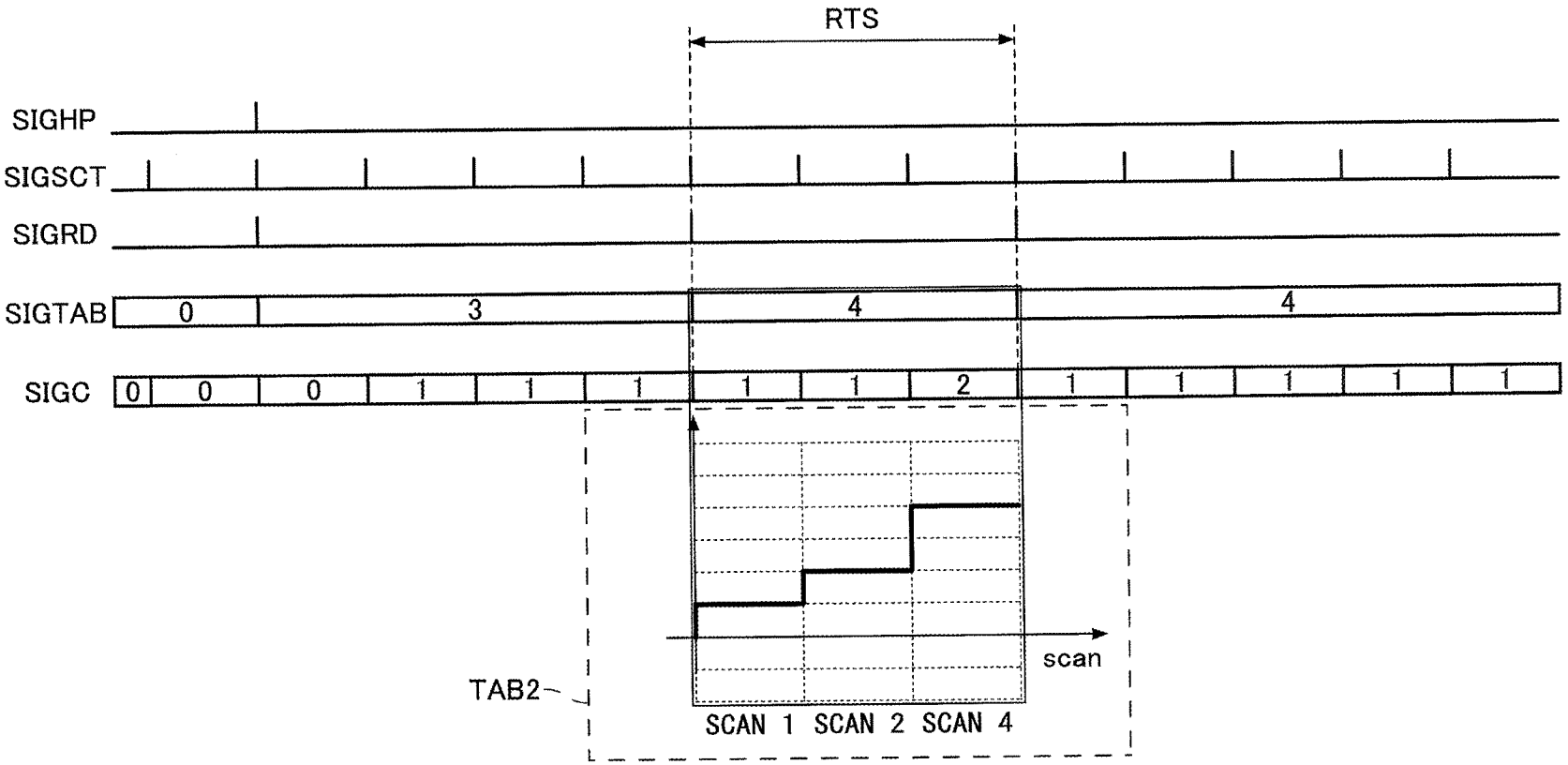
FIG. 21 is a timing chart illustrating another example of the correction cycle corrected by the image forming apparatus, according to the embodiment of the present invention.

FIG. 21 is a timing chart illustrating another example of a correction cycle corrected by the color printer 2000, according to the embodiment of the present invention. In the following example of correcting the correction cycle, the rotation cycle is short. Here, in the example, the correction table is based on the data as illustrated in FIG. 17.

As illustrated in FIG. 17, the correction table includes correcting values of four scans as inputs. That is to say, in the example, the correction cycle consists of four cycles.

On the other hand, the rotation cycle may be shorter, as illustrated in FIG. 21 (hereinafter referred to as a "second rotation cycle RTS"). In the example of FIG. 21, the second rotation cycle RTS consists of three cycles of the scanning signal SIGSCT. That is to say, scanning is performed three times.

In a case where the rotation cycle is short, as exemplified by the second rotation cycle RTS, the color printer 2000 modifies the correction table as an adjustment. Specifically, the color printer 2000 modifies the correction table, so that the correction table includes three scans (hereinafter referred to as a "second correction table TAB2"), as illustrated in FIG. 21. The second correction table TAB2 is different from the correction tables illustrated in FIG. 17 in the way that the third scan SCAN3 does not exist. Here, as an adjustment, the color printer 2000 removes the third scan SCAN3, so that the correction table includes three scans. In such a way, the color printer 2000 corrects the correction table, so that the light intensity is increased by four steps in three scans.

Figure 22:
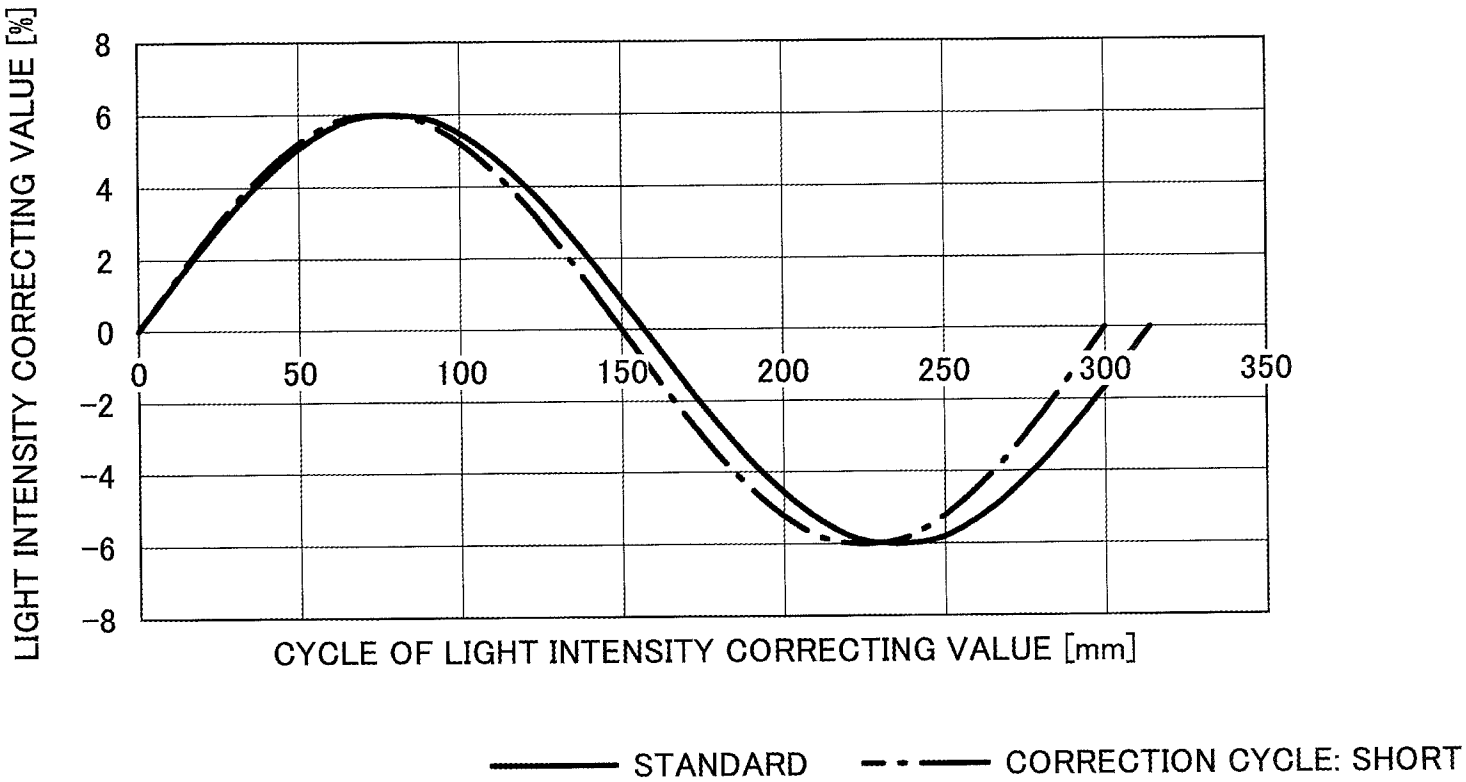
FIG. 22 is a drawing illustrating another example of a result of the adjustment of the correction cycle performed by the image forming apparatus, according to the embodiment of the present invention.

FIG. 22 is a drawing illustrating another example of a result of the adjustment of the correction cycle performed by the color printer 2000, according to the embodiment of the present invention. In the example of FIG. 22, "STANDARD" is indicative of the correction cycles including four scans, where the correction tables illustrated in FIG. 17 are utilized. On the other hand, "CORRECTION CYCLE: SHORT" is indicative of the correction cycles, where the second correction tables TAB2 as illustrated in FIG. 21 are utilized. As illustrated in FIG. 22, the correction cycles of "CORRECTION CYCLE: SHORT" are shorter than the correction cycles of "STANDARD", due to the adjustments. That is to say, even in a case where the rotation cycle is short, the color printer 2000 is capable of shortening the correction cycle through the adjustment as illustrated in FIG. 21, so that the correction cycle completely or almost completely matches the rotation cycle.

Figure 23:
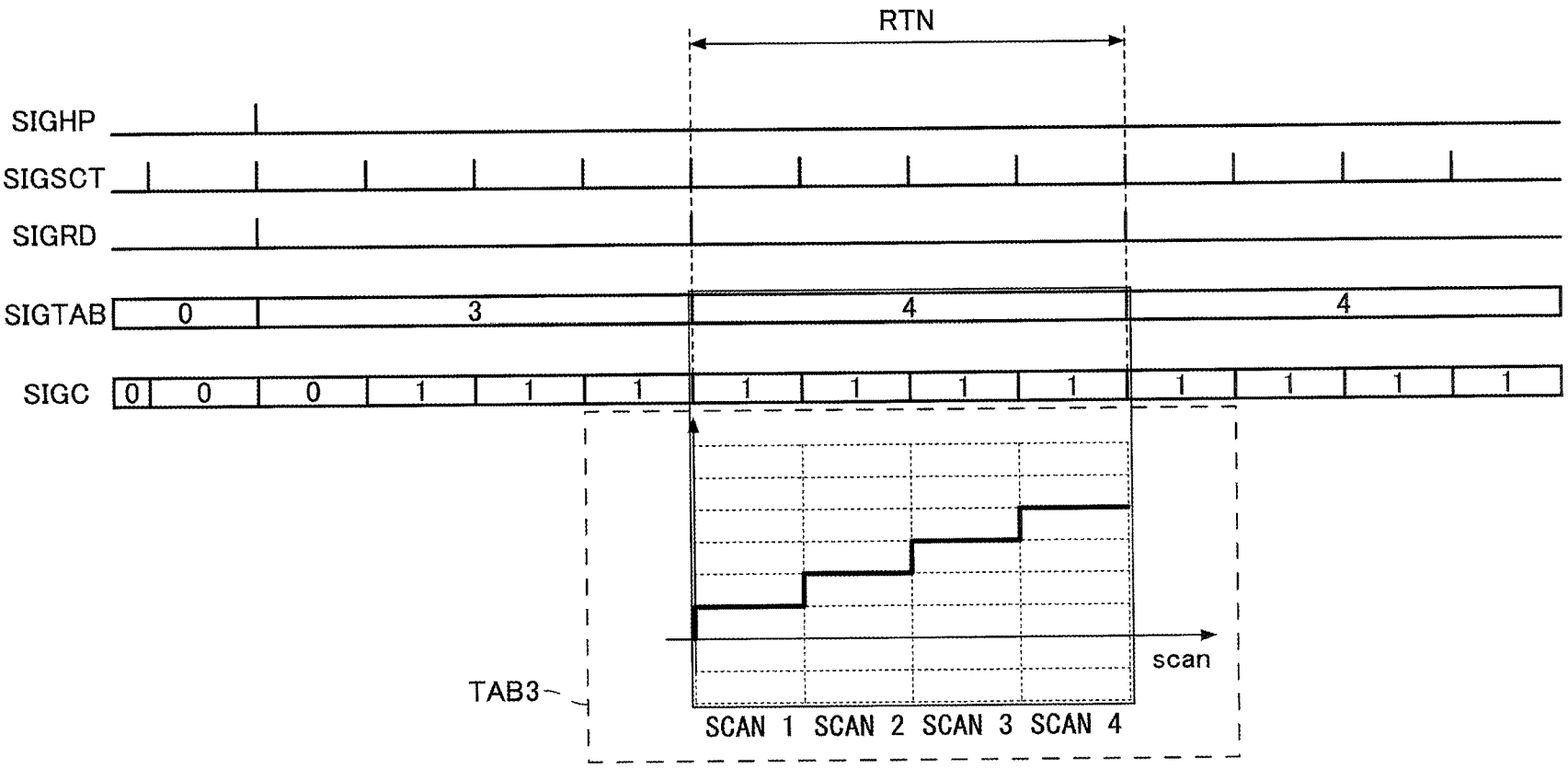
FIG. 23 is a timing chart illustrating an example where the correction cycle of correction performed by the image forming apparatus is "STANDARD", according to the embodiment of the present invention.

FIG. 23 is a timing chart illustrating an example where the correction cycle of correction performed by the color printer 2000 is "STANDARD", according to the embodiment of the present invention. As illustrated in FIG. 23, a rotation cycle (hereinafter referred to as a "third rotation cycle RTN") may consist of four cycles of the scanning signal SIGSCT. That is to say, scanning is performed four times.

In such a case as the third rotation cycle RTN, the color printer 2000 utilizes the correction table as illustrated in FIG. 17. Specifically, the color printer 2000 may select a correction table including four scans (hereinafter referred to as a "third correction table TAB3") out of the correction tables illustrated in FIG. 17. In such a way, the color printer 2000 corrects the correction table, so that the light intensity is increased by four steps in four scans.

Figure 24:
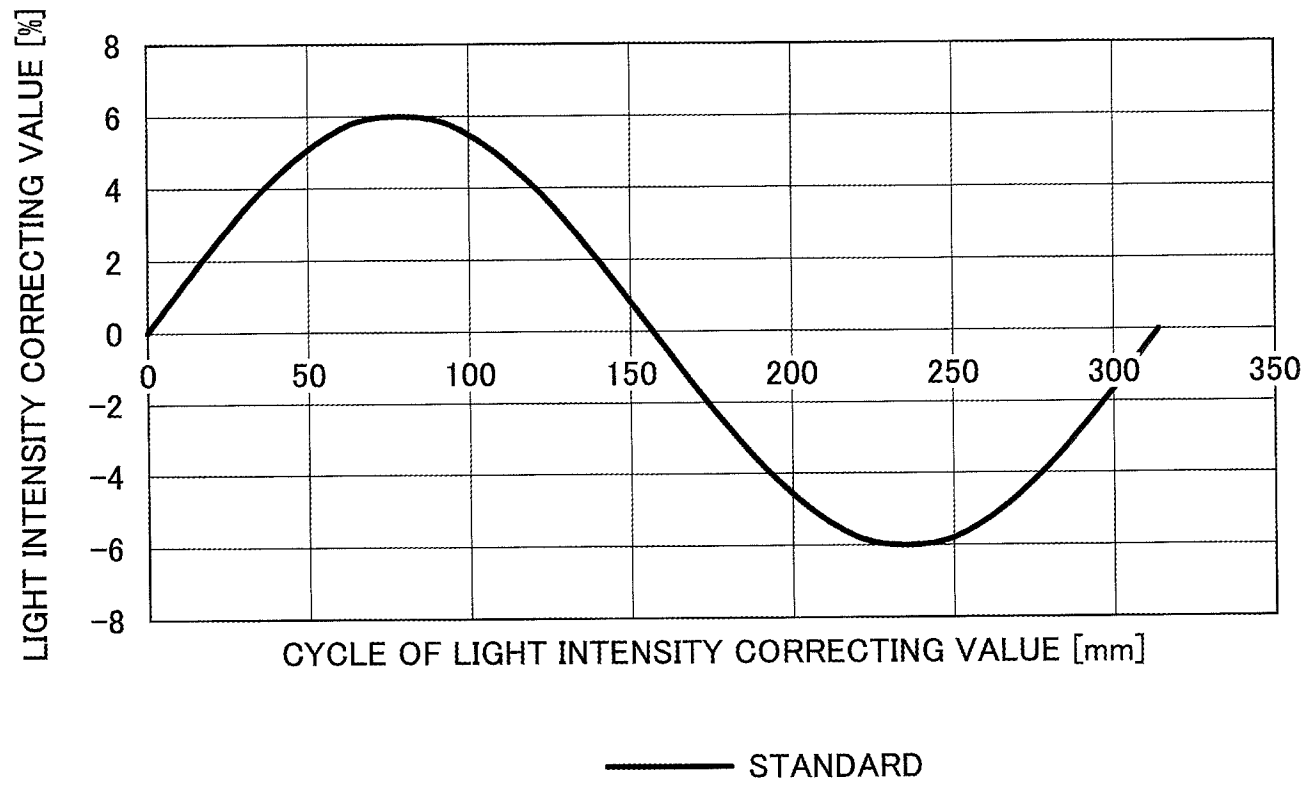
FIG. 24 is a drawing illustrating an example of a result where the correction cycle of correction performed by the image forming apparatus is "STANDARD", according to the embodiment of the present invention.

FIG. 24 is a drawing illustrating an example of a result where the correction cycle of correction performed by the color printer 2000 is "STANDARD", according to the embodiment of the present invention. In the example of FIG. 24, the third correction tables TAB3 illustrated in FIG. 23 are utilized. That is to say, even in a case where the rotation cycle is "STANDARD", etc., the color printer 2000 is capable of matching the correction cycle and the rotation cycle completely or almost completely.

As described above, the color printer 2000 measures a rotation cycle of the photoconductor drum 2030 at each rotation. The rotation cycle is detected, based on a cycle signal, as exemplified by the HP signal SIGHP, etc., illustrated in FIG. 18. Therefore, the color printer 2000 is capable of measuring the rotation cycle in such a method as illustrated in FIG. 18. Meanwhile, an image is formed, based on a latent image formed and developed on the photoconductor drum 2030. The density of the image is detected in such a method as illustrated in FIG. 4, etc. Then, based on the detected density, correction data indicative of correcting values with regard to intensity of light emitted by the light source 2200, as exemplified by the correction table illustrated in FIG. 17, is generated.

As illustrated in FIG. 19 and FIG. 21, there is a chance that a cycle according to the generated correction data does not match the rotation cycle. Therefore, as exemplified by modification of the correction table in FIG. 19 and FIG. 21, the color printer 2000 performs an adjustment, so that the correction cycle and the rotation cycle completely or almost completely match. Here, as the color printer 2000 performs the adjustment on the correction cycle of light intensity, the color printer 2000 need not store correction tables to attend to various types of cycles. Thus, the color printer 2000 may require a small amount of memory for storing the correction table, etc.

Furthermore, in such a way, as the correction cycle and the rotation cycle completely or almost completely match, correction of light intensity may be performed accurately. Further, efficiency of the correction may be improved, as such a process of generating another correction table, etc., may not be required.

As the correction cycle, which is the cycle for correcting light intensity, completely or almost completely matches the rotation cycle, the color printer 2000 is capable of reducing the deviation between the correction cycle and the cycle of the density fluctuation. Here, printing quality may be improved, as the correction of the density fluctuation is performed more effectively due to the decreased deviation between the correction cycle and the cycle of the density fluctuation.

Comparative Example

Figure 25:
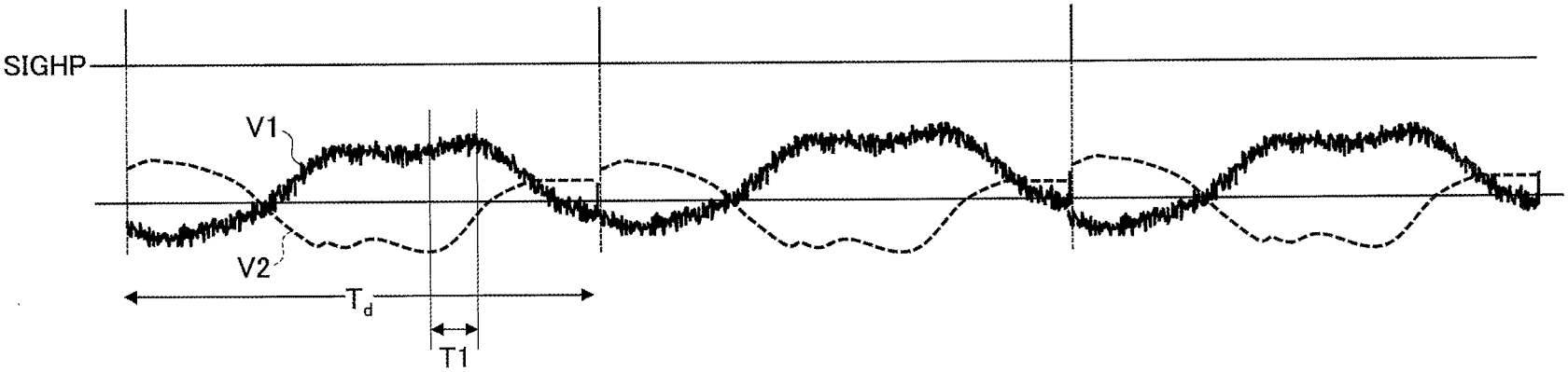
FIG. 25 is a drawing illustrating a comparative example of a case where rotation speed is slow, compared to the embodiment of the present invention.

FIG. 25 is a drawing illustrating a comparative example of a case where rotation speed is slow. A density fluctuation V1 is given, as illustrated in FIG. 25. With respect to the density fluctuation V1, the color printer 2000 corrects light intensity, based on a correcting value V2. For example, a cycle of the density fluctuation V1 changes as the rotation speed becomes slow. Such a change may cause a deviation in phases, as a cycle of the correcting value V2 becomes shorter than the cycle of the density fluctuation V1. In the example of FIG. 25, such a deviation in phases is represented by a "first time T1", etc. As illustrated, correction corresponding to the density fluctuation V1 may be difficult unless the cycle of the density fluctuation V1 completely or almost completely matches the cycle of the correcting value V2.

<Example of Generating Virtual Cycle Signal>

Figure 26:
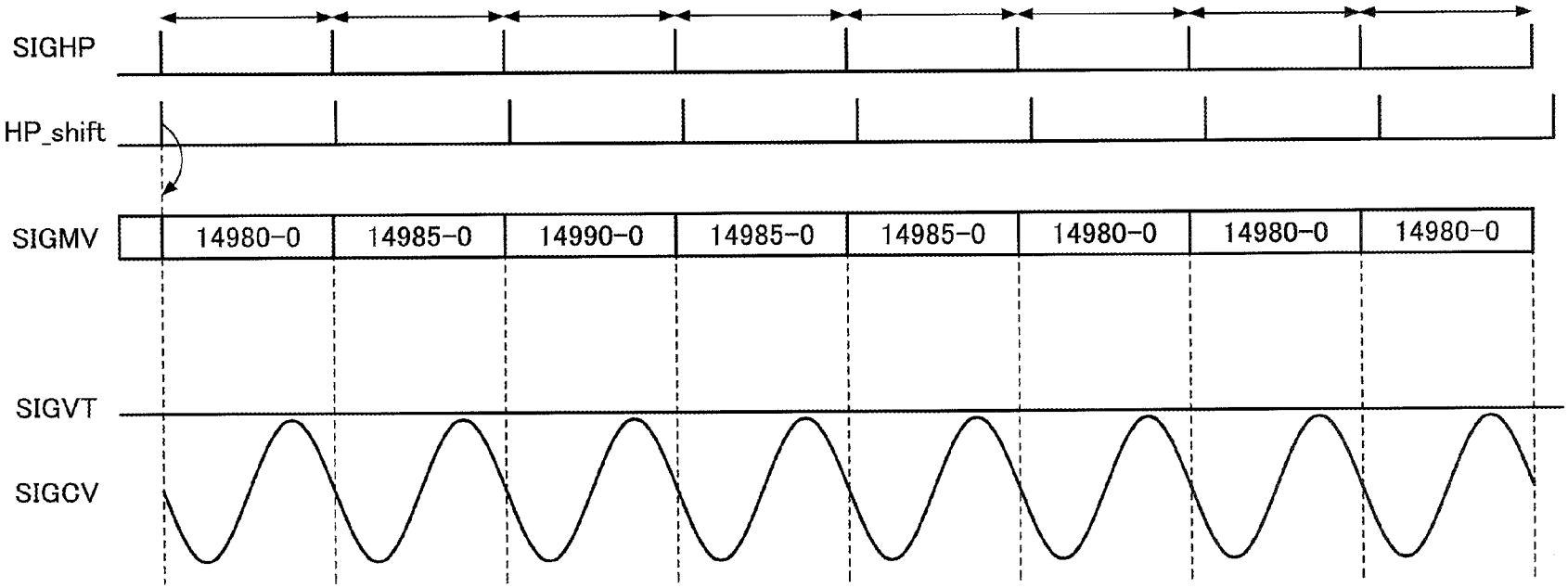
FIG. 26 is a timing chart illustrating an example of a virtual cycle signal generated by the image forming apparatus, according to the embodiment of the present invention.

FIG. 26 is a timing chart illustrating an example of a virtual cycle signal SIGVT generated by the color printer 2000, according to the embodiment of the present invention. As illustrated in FIG. 18, the virtual cycle signal SIGVT is produced based on cycles of the HP signal SIGHP, which are obtained by counting up the number of cycles of the counter signal SIGCNT (see, FIG. 18), etc. In FIG. 26, the counted value is referred to as a measurement value signal SIGMV. The virtual cycle signal SIGVT is generated based on the values of the measurement value signal SIGMV. Here, a correction cycle of a correcting value signal SIGCV, which is indicative of a correcting value, is adjusted in accordance with the virtual cycle signal SIGVT which is generated based on a result of measuring the cycles of the HP signal SIGHP. In such a way, the color printer 2000 is capable of smoothly modifying the correcting values.

Furthermore, a signal "HP_shift" is a signal delayed for a couple of scans compared to the HP signal SIGHP, which is an external input. The signal "HP_shift" is provided, so as to maintain an order in which a cycle is measured and then the measured cycle is reflected on the virtual cycle signal SIGVT. In a case where a cycle of the HP signal HP becomes longer, the virtual cycle signal SIGVT may run out of data in the middle of measurement of a cycle. Therefore, the signal "HP_shift" is provided, in order to attend to such a case where a cycle of the HP signal HP becomes longer.

Here, the color printer 2000 may generate multiple virtual cycle signals SIGVT.

Figure 27:
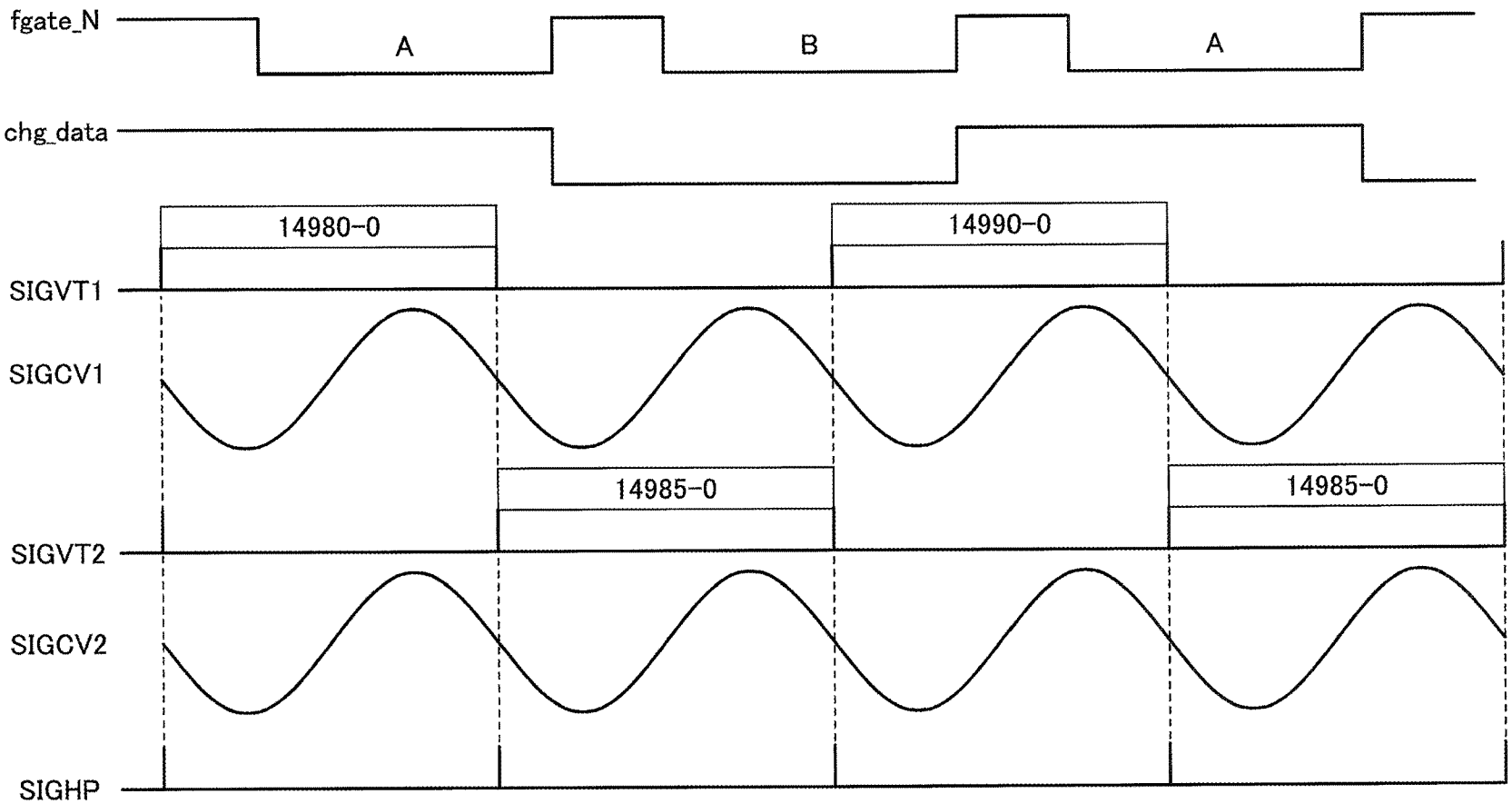
FIG. 27 is a timing chart illustrating an example of multiple virtual cycle signals generated by the image forming apparatus, according to the embodiment of the present invention.

FIG. 27 is a timing chart illustrating an example of multiple virtual cycle signals SIGVT generated by the color printer 2000, according to the embodiment of the present invention. For example, the color printer 2000 generates a "first virtual cycle signal SIGVT1" and a "second virtual cycle signal SIGVT2", as illustrated in FIG. 27. Further, the color printer 2000 generates a "first correcting value signal SIGCV1" and a "second correcting value signal SIGCV2", which are correcting value signals indicative of correcting values with regard to the first virtual cycle signal SIGVT1 and the second virtual cycle signal SIGVT2, respectively.

The color printer 2000 switches the first virtual cycle signal SIGVT1 and the second virtual cycle signal SIGVT2. Similarly, the color printer 2000 switches the first correcting value signal SIGCV1 and the second correcting value signal SIGCV2.

Here, a signal "fgate_N" is a gate signal with regard to the sub-scanning direction, which is indicative of an effective imaging region. The color printer 2000 switches multiple correcting values of light intensity, which are respectively generated based on the multiple virtual cycle signals SIGVT, outside the effective imaging regions by use of the signal "fgate_N", so as to decrease side effects caused by the switching.

Figure 28:
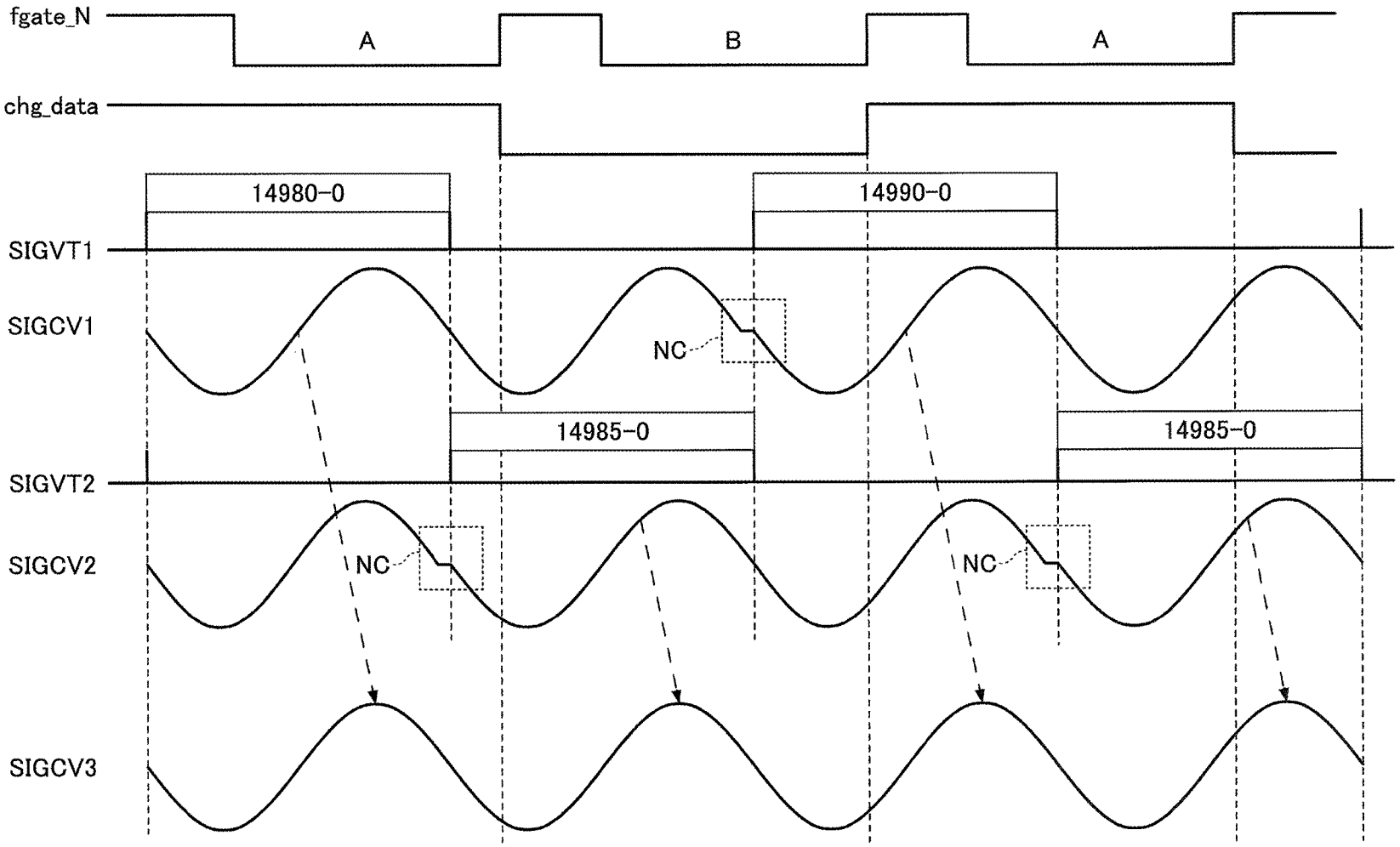
FIG. 28 is a timing chart illustrating an example of utilizing multiple virtual cycle signals generated by the image forming apparatus, according to the embodiment of the present invention.

FIG. 28 is a timing chart illustrating an example of utilizing multiple virtual cycle signals SIGVT generated by the color printer 2000, according to the embodiment of the present invention. For example, the first virtual cycle signal SIGVT1 and the second virtual cycle signal SIGVT2, as well as the first correcting value signal SIGCV1 and the correcting value signal SIGCV2, are switched, by use of a counter switching signal "chg_data", respectively. Specifically, the counter switching signal "chg_data" is switched at every end of the effective imaging regions. As illustrated in FIG. 28, the first virtual cycle signal SIGVT1 and the second virtual cycle signal SIGVT2, as well as the first correcting value signal SIGCV1 and the correcting value signal SIGCV2, are respectively switched based on a cycle, by use of the counter switching signal "chg_data". In a case of utilizing only one virtual cycle signal SIGVT, a deviation in phases between the virtual cycle signal SIGVT and the HP signal SIGHP (see, FIG. 26) may be easily accumulated. Here, the color printer 2000 synchronizes the HP signal SIGHP alternately with the first virtual cycle signal SIGVT1 and the second virtual cycle signal SIGVT2, as illustrated in FIG. 28. In such a way, the color printer 2000 may prevent such accumulation of the deviation in phases between the virtual cycle signals SIGVT and the HP signal SIGHP.

Furthermore, as illustrated in FIG. 28, the first correcting value signal SIGCV1 and the second correcting value signal SIGCV2 may include non-continuous parts NC. Even so, the color printer 2000 may decrease, in the effective imaging regions, such parts which are discontinuous in terms of correction of light intensity.

Further, the present invention is not limited to these embodiments, but various variations and modifications may be made without departing from the scope of the present invention.

What is claimed is:

1. An image forming apparatus comprising:

a photoconductor drum;

an optical scanner including a light source configured to emit light to irradiate the photoconductor drum, the optical scanner configured to scan the photoconductor drum with the light to form a latent image on the photoconductor drum;

a developer configured to perform developing of an image, based on the latent image;

a cycle detector configured to detect a rotation cycle of the photoconductor drum, to produce a cyclic signal indicative of the rotation cycle;

a density detector configured to detect a density of the image formed by the developer; and a controller configured to, measure the rotation cycle at each rotation, based on the cyclic signal to generate a measurement result, generate, based on the density, one or more correcting values for correcting intensity of the light emitted by the light source, the one or more correcting values having a correction cycle based on the measurement result, and adjust a length of the correction cycle based on the rotation cycle measured at each rotation to generate a length-adjusted correction cycle, so that the length of the length-adjusted correction cycle matches a length of the rotation cycle by correcting, in a one-time implementation, the intensity of the light emitted by the light source using one or more correcting values corresponding to the generated one or more correcting values in such a manner that a beginning and an end of the one-time implementation of the correcting of the intensity of the light emitted by the light source are coincident with a beginning and an end of the length-adjusted correction cycle, respectively.

2. The image forming apparatus according to claim 1, wherein the controller is configured to measure the rotation cycle at each rotation by, counting a number of cycles of a signal whose cycle is shorter than a cycle of the cyclic signal, measuring the cycle of the cyclic signal based on one of (i) the number of cycles counted in one cycle of the cyclic signal and (ii) a moving average of the number of cycles over a plurality of cycles of the cyclic signal, and measuring the rotation cycle at each rotation, based on the cycle of the cyclic signal.

3. The image forming apparatus according to claim 1, further comprising:

a memory configured to store a correction table that indicates the one or more correcting values.

4. The image forming apparatus according to claim 3, wherein the controller is configured to adjust the correction cycle by adding, to the correction table, one or more correcting values in response to determining to lengthen the correction cycle to match the correction cycle to the rotation cycle.

5. The image forming apparatus according to claim 3, wherein the controller is configured to adjust the correction cycle by removing, from the correction table, one or more correcting values in response to determining to shorten the correction cycle to match the correction cycle to the rotation cycle.

6. The image forming apparatus according to claim 1, wherein the controller is configured to generate at least one virtual cycle signal based on the measurement result.

7. The image forming apparatus according to claim 6, wherein the at least one virtual cycle signal includes a plurality of virtual cycle signals.

8. The image forming apparatus according to claim 7, wherein the controller is configured to switch between the plurality of virtual cycle signals.

9. The image forming apparatus according to claim 1, wherein the cycle detector is configured to detect a home position of the photoconductor drum, and the controller is configured to measure a time from a first detection of the home position associated with a first rotation cycle of the photoconductor drum to second detection of the home position associated with a second rotation cycle of the photoconductor drum.

10. The image forming apparatus according to claim 1, wherein the optical scanner is configured to scan the photoconductor drum based on a modulation signal, and the controller is configured to adjust the correction cycle by modifying the modulation signal.

11. The image forming apparatus according to claim 1, wherein the controller is configured to adjust the correction cycle based on the rotation cycle measured at each rotation by modifying a number of scans included in the correction cycle such that the length-adjusted correction cycle matches the rotation cycle.

12. A method of operating an image forming apparatus, the image forming apparatus including a photoconductor drum and an optical scanner, the method comprising:

scanning the photoconductor drum with light irradiated from a light source of the optical scanner to form a latent image on the photoconductor drum;

developing an image, based on the latent image;

detecting a rotation cycle of the photoconductor drum, to produce a cyclic signal indicative of the rotation cycle;

detecting a density of the image formed by the developing;

measuring the rotation cycle at each rotation, based on the cyclic signal to generate a measurement result;

generating, based on the density, one or more correcting values for correcting intensity of the light emitted by the light source, the one or more correcting values having a correction cycle based on the measurement result of the measuring; and adjusting a length of the correction cycle based on the rotation cycle measured at each rotation to generate a length-adjusted correction cycle, so that the length of the length-adjusted correction cycle matches a length of the rotation cycle by correcting, in a one-time implementation, the intensity of the light emitted by the light source using one or more correcting values corresponding to the generated one or more correcting values in such a manner that a beginning and an end of the one-time implementation of the correcting of the intensity of the light emitted by the light source are coincident with a beginning and an end of the length-adjusted correction cycle, respectively.

13. The method according to claim 12, wherein the measuring of the rotation cycle at each rotation comprises:

counting a number of cycles of a signal whose cycle is shorter than a cycle of the cyclic signal;

measuring the cycle of the cyclic signal based on one of (i) the number of cycles counted in one cycle of the cyclic signal and (ii) a moving average of the number of cycles over a plurality of cycles of the cyclic signal; and measuring the rotation cycle at each rotation, based on the cycle of the cyclic signal.

14. The method according to claim 12, wherein the adjusting the correction cycle comprises:

adding, to a correction table, one or more correcting values in response to determining to lengthen the correction cycle to match the correction cycle to the rotation cycle.

15. The method according to claim 12, wherein the adjusting the correction cycle comprises:

removing, from a correction table, one or more correcting values in response to determining to shorten the correction cycle to match the correction cycle to the rotation cycle.

16. The method according to claim 12, further comprising:

generating a plurality of virtual cycle signals based on the measurement result; and switching between the plurality of virtual cycle signals.

17. The method of claim 12, wherein the scanning scans the photoconductor drum based on a modulation signal, and the adjusting adjusts the correction cycle by modifying the modulation signal.

18. The method of claim 12, wherein the adjusting adjusts the correction cycle based on the rotation cycle measured at each rotation by modifying a number of scans included in the correction cycle such that the length-adjusted correction cycle matches the rotation cycle.

* * * * *